US010148015B2

(12) United States Patent
Heyde et al.

(10) Patent No.: US 10,148,015 B2
(45) Date of Patent: Dec. 4, 2018

(54) DIPOLE-SHAPED ANTENNA ELEMENT ARRANGEMENT

(71) Applicant: KATHREIN-WERKE KG, Rosenheim (DE)

(72) Inventors: Wolfgang Heyde, Tuntenhausen (DE); Markus Quitt, Rohrdorf (DE); Johannes Kellerer, Tuntenhausen (DE)

(73) Assignee: Kathrein-Werke KG, Rosenheim (DE)

( * ) Notice: Subject to any disclaimer, the term of this patent is extended or adjusted under 35 U.S.C. 154(b) by 160 days.

(21) Appl. No.: 15/455,505

(22) Filed: Mar. 10, 2017

(65) Prior Publication Data

US 2017/0264021 A1 Sep. 14, 2017

(30) Foreign Application Priority Data

Mar. 14, 2016 (DE) ..... 10 2016 104 611
Jul. 5, 2016 (DE) ..... 10 2016 112 280

(51) Int. Cl.

| | |
|---|---|
| ***H01Q 1/24*** | (2006.01) |
| ***H01Q 21/24*** | (2006.01) |
| ***H01Q 9/28*** | (2006.01) |
| ***H01Q 19/30*** | (2006.01) |

(52) U.S. Cl.

CPC ..... *H01Q 9/285* (2013.01); *H01Q 1/246* (2013.01); *H01Q 19/30* (2013.01); *H01Q 21/24* (2013.01)

(58) Field of Classification Search

CPC ..... H01Q 1/246; H01Q 9/285; H01Q 19/30; H01Q 21/24; H01Q 21/26; H01Q 21/28; H01Q 21/30

See application file for complete search history.

(56) References Cited

U.S. PATENT DOCUMENTS

| | | | |
|---|---|---|---|
| 2010/0182213 | A1 | 7/2010 | Obermaier et al. |
| 2010/0283707 | A1 | 11/2010 | Foo |

FOREIGN PATENT DOCUMENTS

| | | | |
|---|---|---|---|
| CN | 203232955 | U | 10/2013 |
| CN | 203386887 | | 1/2014 |
| CN | 103380542 | B | 8/2015 |
| DE | 196 27 015 | | 1/1998 |
| DE | 197 22 742 | | 12/1998 |
| EP | 2 595 243 | A1 | 5/2013 |
| WO | WO 00/39894 | | 7/2000 |
| WO | WO 2004/100315 | | 11/2004 |
| WO | WO 2005/060049 | | 6/2005 |
| WO | WO 2008/017385 | | 2/2008 |
| WO | 2014/205733 | A1 | 12/2014 |

OTHER PUBLICATIONS

European Search Report dated Aug. 2, 2017, issued in European Patent Application No. 17160394.

*Primary Examiner* — Tho G Phan
*Assistant Examiner* — Patrick Holecek
(74) *Attorney, Agent, or Firm* — Nixon & Vanderhye P.C.

(57) ABSTRACT

A dipole-shaped antenna element arrangement comprises two pairs of radiator halves which are arranged so as to be rotated by 90° to one another and are oriented in a radiator plane at a distance in front of a reflector and in parallel therewith. The radiator halves are arranged on a balancing and/or support arrangement. There is a passive beam-shaping frame which is arranged at a distance from the radiator halves towards the reflector. The passive beam-shaping frame has at the corners thereof a broadening of the peripheral frame web thereof, said broadening of the frame web extending in parallel with the radiator plane and/or transversely to the radiator plane.

20 Claims, 13 Drawing Sheets

1

DIPOLE-SHAPED ANTENNA ELEMENT ARRANGEMENT

CROSS-REFERENCE TO RELATED APPLICATIONS

Priority is claimed from DE 10 2016 104 611.6 filed Mar. 14, 2016; and DE 10 2016 112 280.7 filed July OS, 2016, both incorporated herein by reference as if expressly set forth.

FIELD

The technology herein relates to a dipole-shaped antenna element arrangement.

BACKGROUND AND SUMMARY

Dipole radiators have been disclosed, for example, by the prior publications DE 197 22 742 A and DE 196 27 015 A. Dipole radiators of this type can have a common dipole structure or can consist, for example, of a crossed dipole or a dipole square, etc.

What is known as a vector dipole is disclosed, for example, by the prior publication WO 00/39894 A1. The structure of said dipole appears to be comparable to a dipole square. Due to the specific construction of the dipole radiator according to this prior publication and the special feed-in, however, this dipole radiator operates similarly to a crossed dipole which radiates in two polarisation planes oriented perpendicularly to one another. From a design standpoint, however, it is rather formed in the shape of a square, in particular due to the design of the outer contour thereof.

WO 2004/100315 A1 disclosed a further design of the aforementioned vector dipole in which the faces of each radiator half of a polarisation can be closed to a large extent over the whole surface.

Dipole radiators of this type are typically fed in such a way that one dipole half or radiator half is connected with regard to d.c. current (that is to say galvanically) to an outer conductor, whereas the inner conductor of a coaxial connection cable is connected with regard to d.c. current (thus also galvanically) to the second dipole half or radiator half. In this case, the feed-in takes place at the end regions of the dipole halves or radiator halves that face one another.

From WO 2005/060049 A1, it is known to carry out an outer conductor feed by means of a capacitive outer conductor coupling. For this purpose, the respectively associated halves of the supporting device of the antenna element arrangement can be galvanically connected to earth or capacitively coupled to earth at the foot region or at the base of the supporting device.

From CN 203386887 U, a dipole-shaped antenna element arrangement is known which comprises two pairs of radiator halves which are arranged so as to be rotated by 90° with respect to one another, so that the dipole-shaped antenna element arrangement radiates in two polarisation planes which are arranged perpendicularly to one another. Furthermore, a passive beam-shaping frame is disclosed which is arranged in parallel with the radiator halves at a distance therefrom in the direction of the reflector. Additionally, a director is disclosed which is arranged in parallel with the radiator halves, the radiator halves being arranged closer to the reflector than the director.

A disadvantage of the antenna element arrangements from the prior art is that the antenna element arrangements have too small a bandwidth for some uses.

The example non-limiting technology herein provides a dipole-shaped antenna element arrangement which can be used in mobile communication antennae and which has a bandwidth that is greater than in the antenna element arrangements known from the prior art.

This is achieved by means of the dipole-shaped antenna element arrangement is described herein. Developments of the dipole-shaped antenna element arrangement are indicated in the detailed description.

The dipole-shaped antenna element arrangement comprises two pairs of radiator halves which are arranged so as to be rotated by 90° with respect to one another, so that the dipole-shaped antenna element arrangement transmits and/or receives in two polarisation planes which are arranged perpendicularly to one another. Two radiator halves, which in this case form a pair, are arranged diagonally to one another. The radiator halves can be arranged or are arranged in a radiator plane at a distance in front of a reflector and in parallel therewith. A balancing and/or support arrangement comprising a first end and a base at a second end, which is opposite the first end, is used to hold the two radiator halves, said halves being arranged at the first end of the balancing and/or support arrangement. The base of the balancing and/or support arrangement can be fastened to a base body. Said base body is, for example, a circuit board or the reflector wherein, by means of the circuit board, preferably at least an indirect fastening to the reflector takes place. In order to increase the bandwidth, a passive beam-shaping frame is provided which is arranged towards the base at a distance from the radiator halves. The passive beam-shaping frame consists of a plurality of frame sides which form a peripheral frame web which defines an opening. The passive beam-shaping frame is oriented in parallel with the radiator plane. The passive beam-shaping frame has, in the region of the corners thereof, a broadening of the peripheral frame web thereof, said broadening of the frame web extending in parallel with the radiator plane and/or transversely to the radiator plane. By means of this forming of the passive beam-shaping frame, in contrast to the beam-shaping frames known from the prior art, the bandwidth can be appreciably increased. In particular, the reflection factor of the dipole-shaped antenna element arrangement improves in the lower frequency range. A dipole-shaped antenna element arrangement of this type can therefore be used, in particular, in the frequency range from approximately 550 MHz to approximately 960 MHz. The dipole-shaped antenna element arrangement can also be used for other frequency ranges which lie above or below this.

According to a preferred embodiment, the broadenings of the frame web extend on the inner peripheral wall thereof so that, in the region of the corners thereof, the frame web extends closer towards a longitudinal axis through the dipole-shaped antenna element arrangement. It is also possible that, alternatively or additionally thereto, the broadenings of the frame web extend on the outer peripheral wall thereof.

In another development, in a plan view of the dipole-shaped antenna element arrangement, at least part of the radiator halves overlap at least in part or in full with the broadenings of the frame web which are formed on the inner peripheral wall thereof.

The broadenings preferably occur in a tapered manner, that is to say, extending discontinuously in one or more steps. It is also possible for the broadenings to occur continuously.

In a preferred embodiment, the outer peripheral wall of the frame web is bevelled in the region of the corners thereof, wherein at said bevel, the broadening is formed transversely to the radiator plane. The broadening can extend either transversely to the radiator plane towards the base of the antenna element arrangement or in the direction of the radiator plane. The broadening preferably extends perpendicularly to the radiator plane. The corners of the outer peripheral wall of the frame web are preferably bevelled over a length which corresponds to approximately the width of the frame web at the non-broadened points thereof. The broadenings extend perpendicularly to the radiator plane, preferably over a length which also corresponds to approximately the width of the frame web at the non-broadened points thereof.

In another embodiment of the dipole-shaped antenna element arrangement, in each case two frame sides of the frame web extend towards one another forming a corner, wherein the broadenings in parallel with the radiator plane at the individual frame sides of the peripheral frame web, that is to say, those which extend towards one another forming a corner, occur over a partial length of the respective frame sides, wherein the partial lengths each extend equally far away from the corners. This results in a particularly symmetrical structure.

In a further embodiment of the dipole-shaped antenna element arrangement, a plurality or all of the frame sides of the passive beam-shaping frame each have a vane in the middle thereof, extending approximately in parallel with the radiator plane or transversely to the radiator plane. These vanes are preferably formed, in plan view, so as to be rectangular or square. They can also be trapezoid or semicircular or half-oval, and/or the edge contour can be formed so as to be n-polygonal in plan view. The vanes extend further, preferably towards the centre of the passive beam-shaping frame and, in this case, are provided on an inner peripheral wall of the frame web. It is also possible for the vanes to extend in the opposite direction, that is, outwardly. In that case, they would be arranged on an outer peripheral wall of the frame web.

In addition thereto, the bandwidth can also be increased in that a director is used, wherein the director is oriented in parallel with the radiator plane. In this case, the radiator halves are arranged or can be arranged closer to the base than the director. In this case, the outer sides of the director are rotated at an angle of between 30° and 60°, preferably 45° to the outer sides and/or inner sides of the radiator halves.

In a further embodiment of the dipole-shaped antenna element arrangement, the director comprises a recess in the centre thereof. This recess is square, wherein the inner sides of the recess of the director extend in parallel with the outer sides of the director. The director preferably comprises on each outer side a tongue protruding outwardly, that is to say, in parallel with the radiator plane. Said protruding tongue is preferably provided in the middle of each outer side of the director. By means of such a tongue, and also by means of the recess itself, the bandwidth with which the dipole-shaped antenna element arrangement can be operated can be increased.

In place of a director, in order to further increase the bandwidth, a plurality of metal strips can also be used, which are oriented in parallel with the radiator plane. In this case, the radiator halves are arranged closer to the base than the metal strips. Seen in plan view, the metal strips are arranged on the dipole-shaped antenna element arrangement in the region of the outer sides of the radiator halves. The metal strips are preferably rectangular structures.

A metal strip of this type extends, in each case, approximately in parallel with in each case two outer sides of two adjacent radiator halves. In this case, the two radiator halves belong to different pairs of radiator halves. Particularly good results are achieved if each metal strip extends in parallel with a frame side of the frame web. Preferably, each metal strip is arranged in such a way that it does not overlap with a recess which is situated within the radiator halves and is defined by each radiator half. The metal strips act as parasitically coupled resonators. In this case, the height of the resonators above the dipole is less than when using a director. As a result, the dipole-shaped antenna element arrangement can be more compactly constructed and also placed in smaller radomes.

In another embodiment, the metal strips are arranged further away from a longitudinal axis penetrating the centre of the antenna element arrangement than the respective outer sides of the radiator halves.

In a further embodiment, preferably at least four metal strips are used. In each case one of the metal strips is arranged in the region of the outer sides of in each case two adjacent radiator halves. In this case, two adjacent metal strips preferably extend at an angle of approximately 90° to one another in each case, whereby said strips end at a distance from one another.

In an additional embodiment of the dipole-shaped antenna element arrangement, a plurality of possibilities are disclosed as to how the metal strips can be arranged in comparison with the two outer sides of two adjacent radiator halves. For example, it is possible, in a plan view of the dipole-shaped antenna element arrangement, for at least part of the width of the at least one metal strip to overlap the two outer sides of the two adjacent radiator halves. In this case, preferably, the area of the metal strip which overlaps the first radiator half is approximately as large as the area of the metal strip which overlaps the second radiator half. Alternatively, it is also possible for the at least one metal strip to directly abut two outer sides of two adjacent radiator halves without any overlap taking place. In this case, an imaginary plane extending through the side walls of the outer sides of the adjacent radiator halves and through the outer side of the metal strip would lie perpendicularly to the radiator plane. Furthermore, it is alternatively possible for the at least one metal strip to be arranged so as to be offset relative to the two outer sides of the two adjacent radiator halves without overlap in such a way that, in a plan view, a gap is also formed between the metal strip and the two adjacent radiator halves. In this case, the metal strip extends further outwards than the two outer sides of the radiator halves.

Preferably, the length of the metal strips corresponds approximately to a quarter of the wavelength of the centre frequency.

In another embodiment, the passive beam-shaping frame is held, together with the director or the metal strips, galvanically separated via at least one combined holding and spacing element, supported on one or all of the radiator halves and at a distance therefrom. By this means, the assembly can be significantly simplified.

BRIEF DESCRIPTION OF THE DRAWINGS

Different embodiments will now be described by way of example, with reference to the drawings. Identical objects have the same reference signs. The corresponding figures of the drawings show, in detail.

Figure 3:
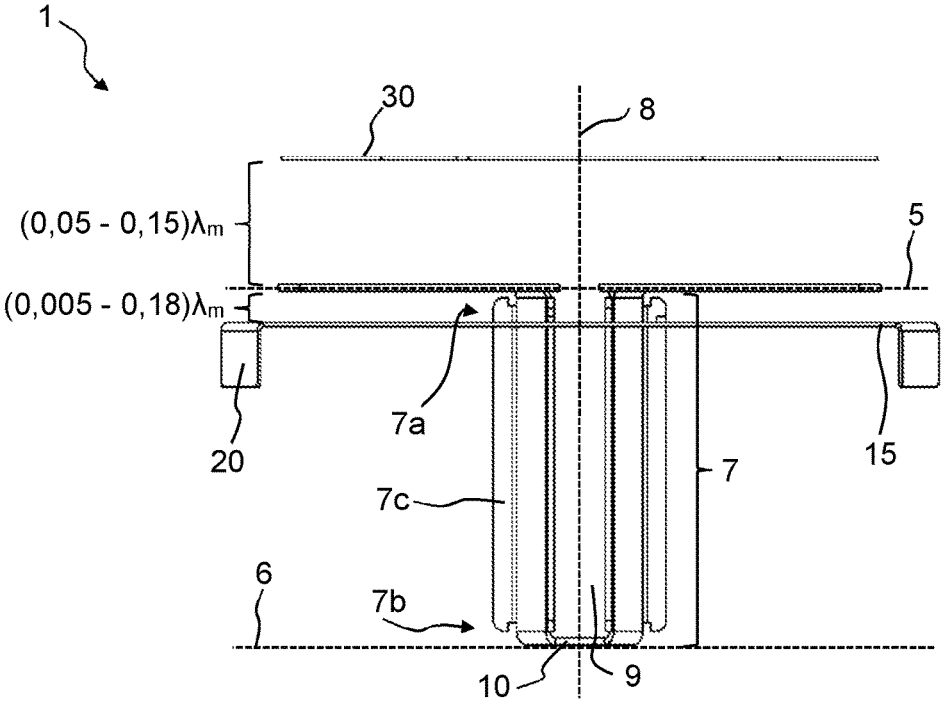
Figure 4:
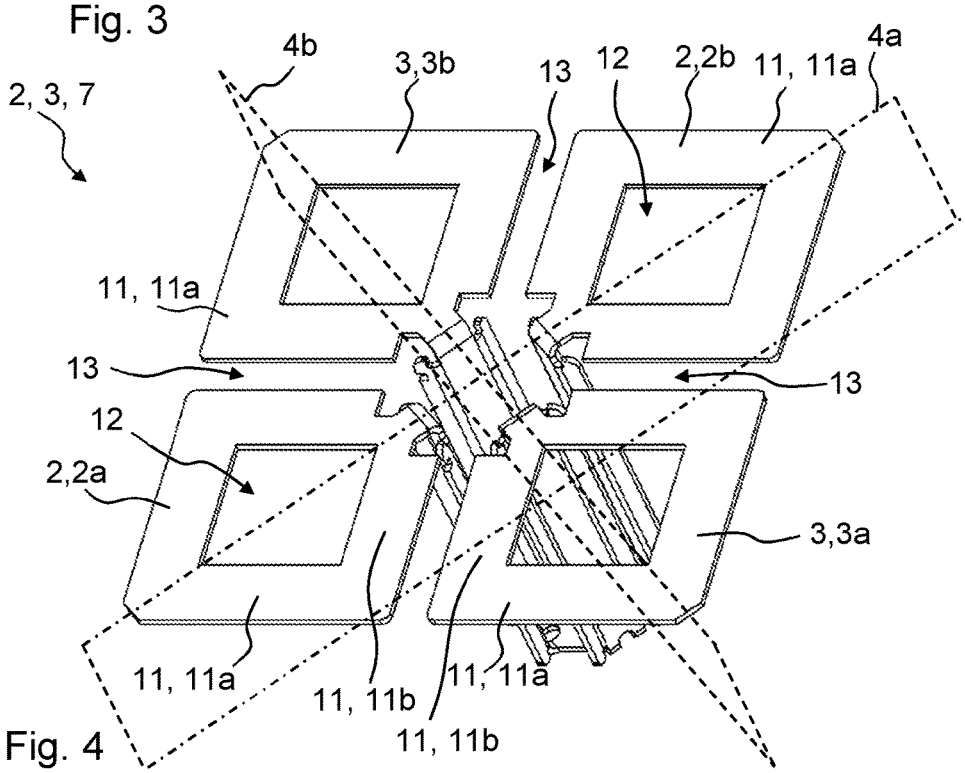
Figure 7:
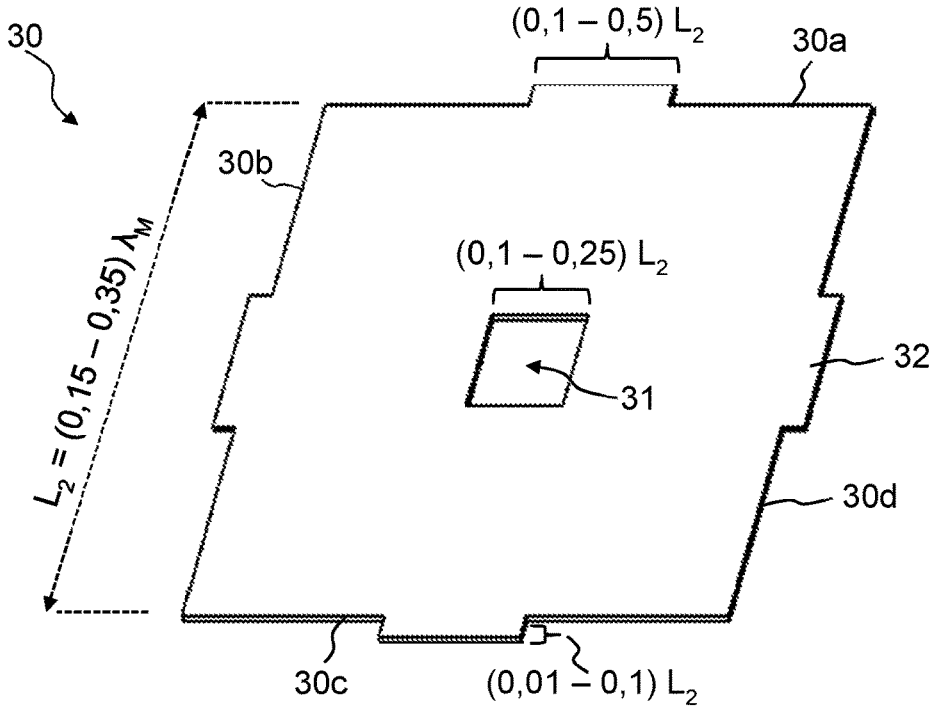
Figure 9A:
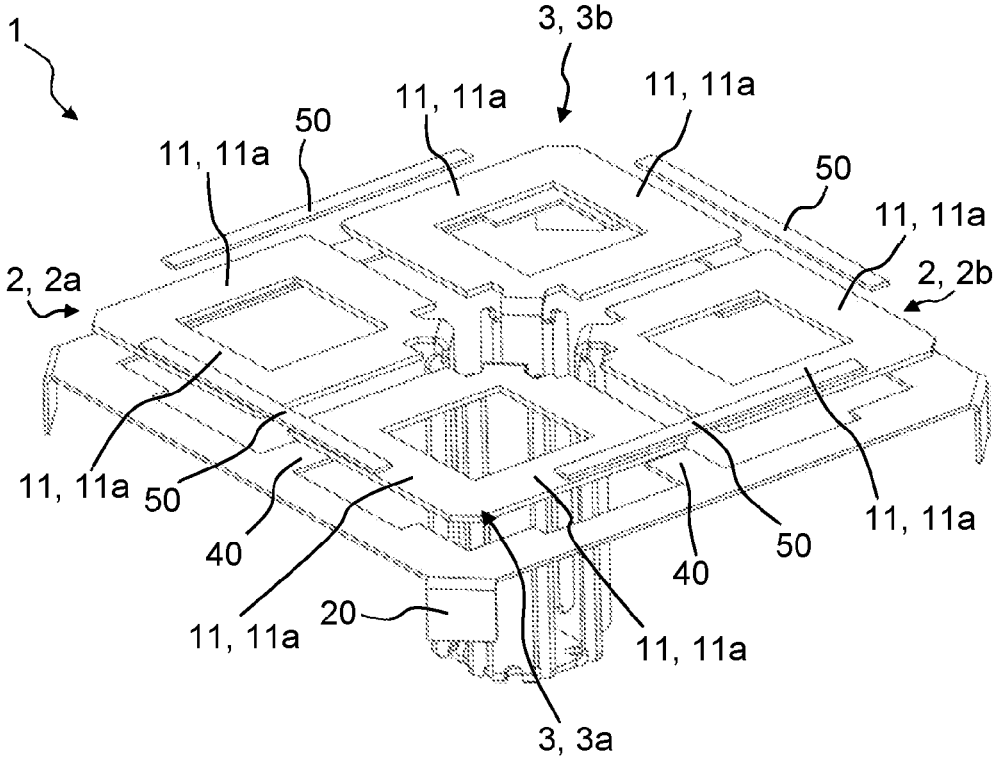
Figure 9B:
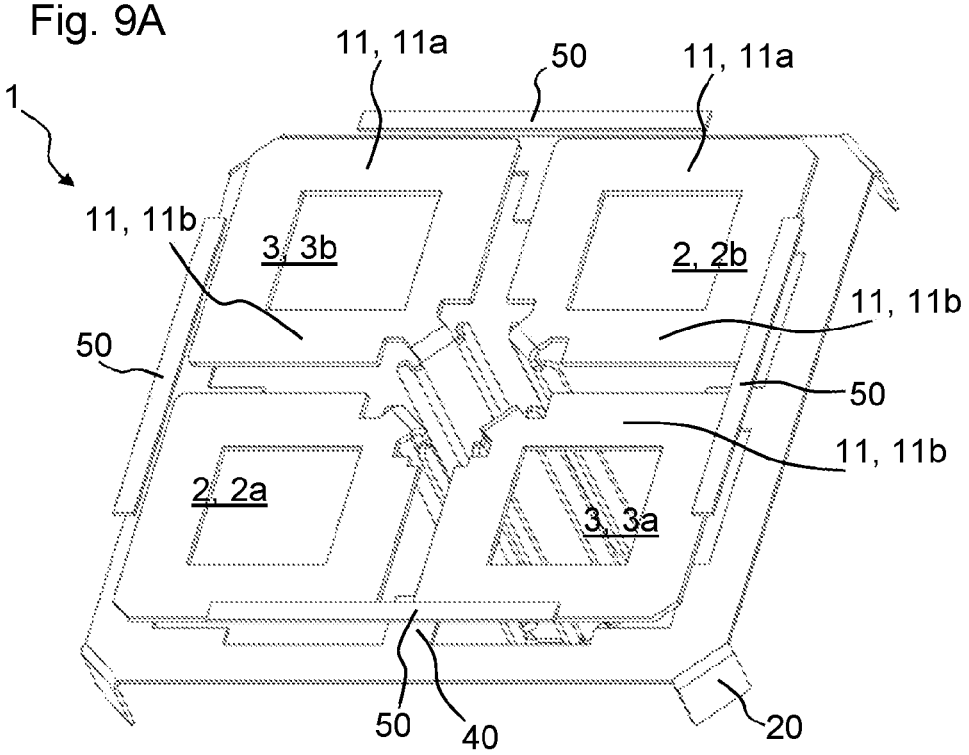
Figure 9C:
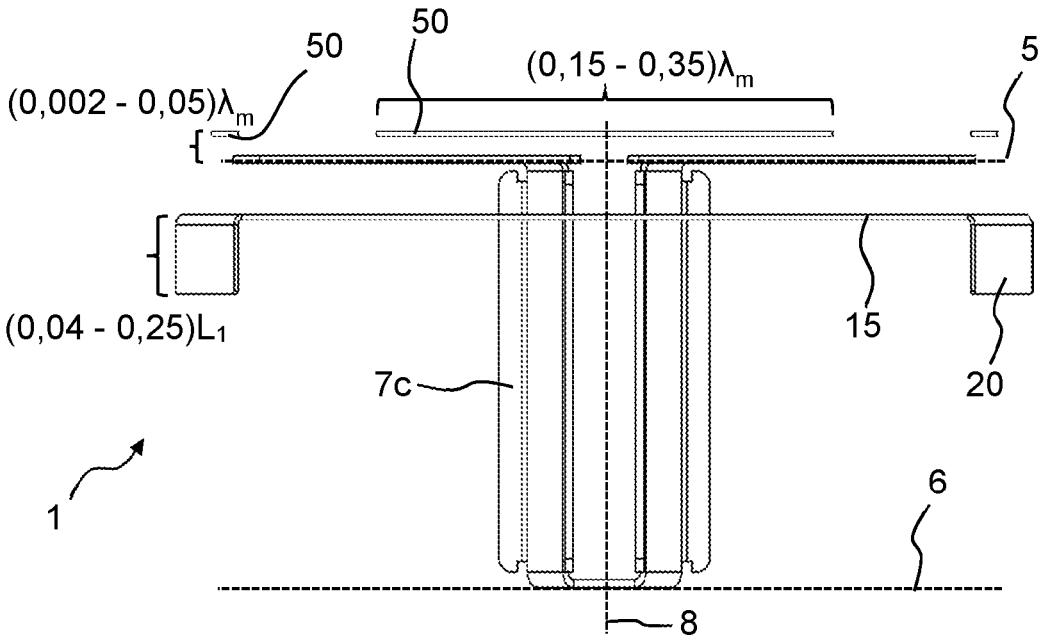
Figure 10:
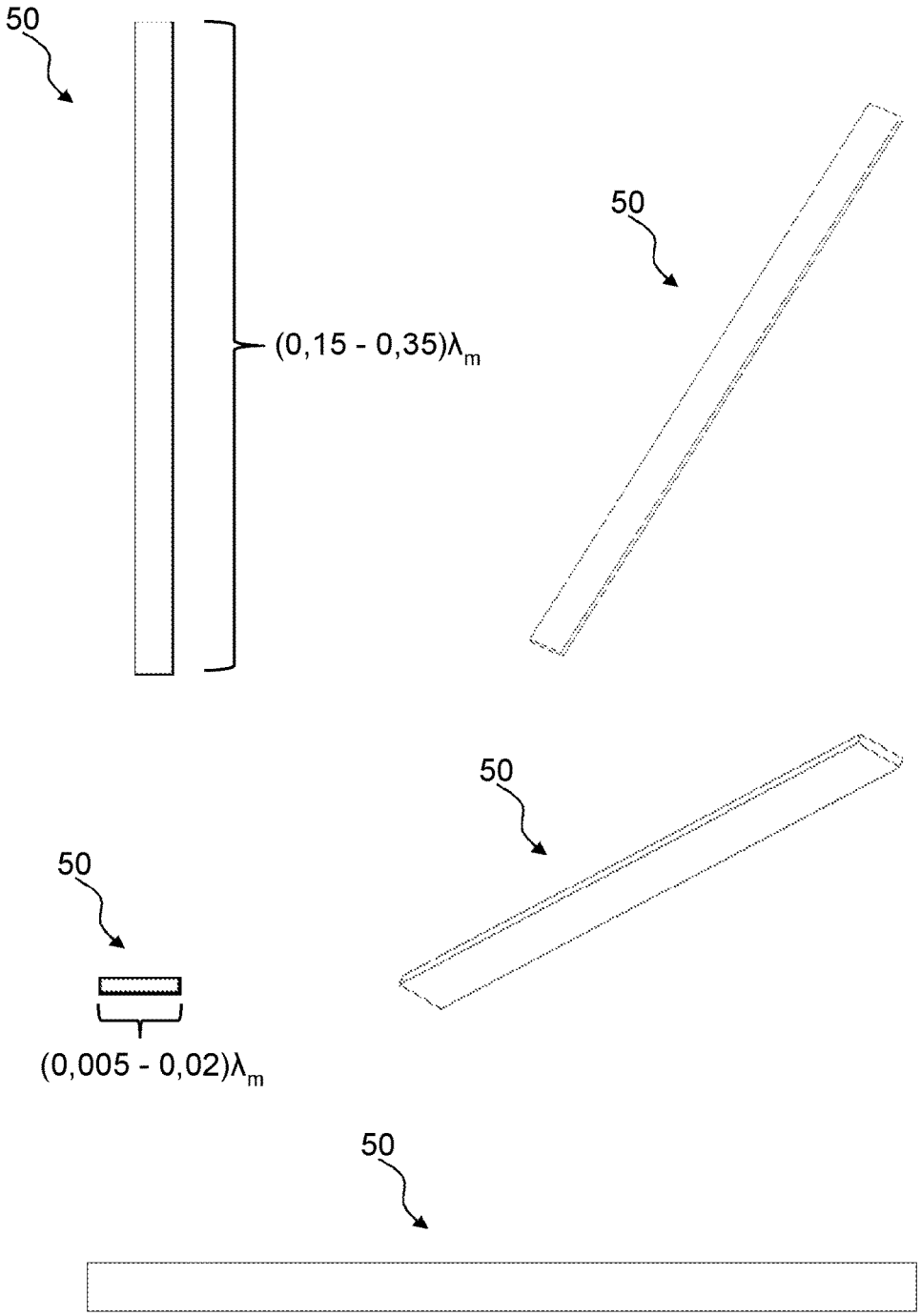

different spatial representations of the dipole-shaped antenna element arrangement;

FIG. 3: a lateral view of the dipole-shaped antenna element arrangement;

FIG. 4: a three-dimensional view of the radiator halves together with a balancing and/or support arrangement;

FIG. 5A to 5C:

different representations of a passive beam-shaping frame;

FIG. 6A, 6B:

a view from above and a view from below of the dipole-shaped antenna element arrangement;

FIG. 7: a three-dimensional view of a director;

FIG. 8A to 8E:

different views of the passive beam-shaping frame according to a further embodiment;

FIG. 9A, 9B:

different three-dimensional views of the dipole-shaped antenna element arrangement according to the further embodiment;

FIG. 9C: a lateral view of the dipole-shaped antenna element arrangement according to the further embodiment;

FIG. 9D to 9H:

different plan views of different embodiments of the dipole-shaped antenna element arrangement; and FIG. 10: different views of a metal strip.

DETAILED DESCRIPTION OF EXAMPLE NON-LIMITING EMBODIMENTS

Figure 1:
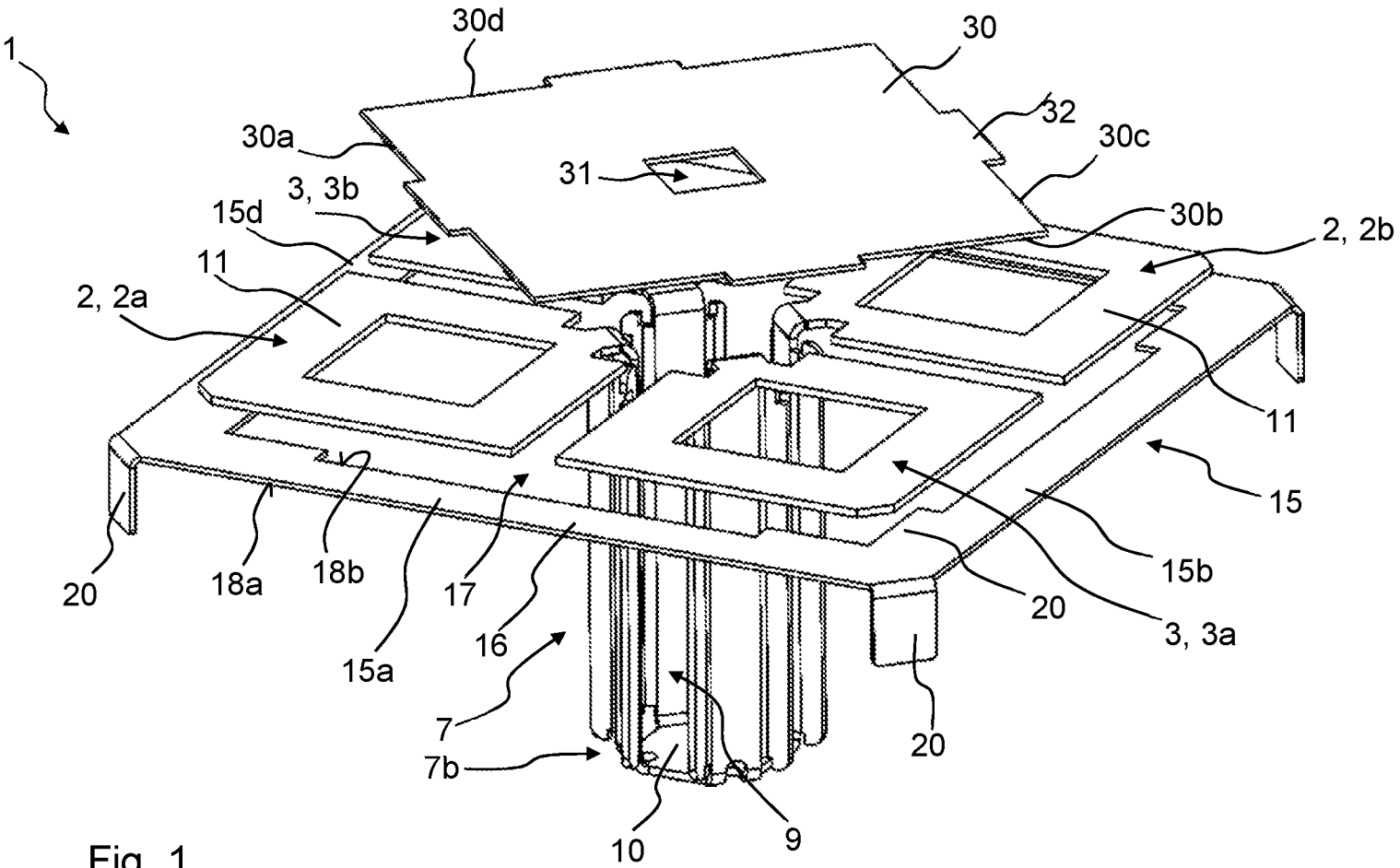
FIGS. 1 and 2.
Figure 2:
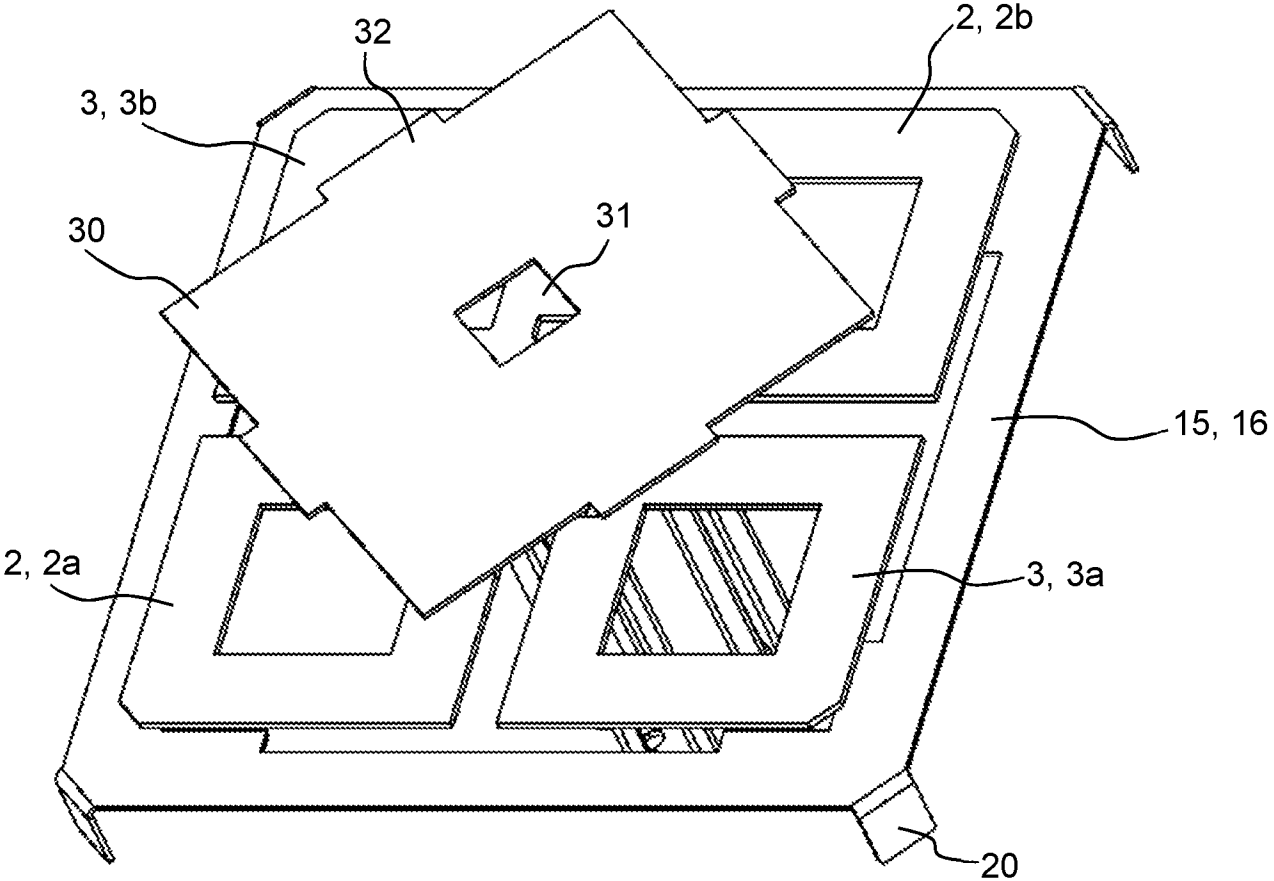

FIGS. 1 and 2 show different three-dimensional views of the dipole-shaped antenna element arrangement 1. The dipole-shaped antenna element arrangement 1 comprises two pairs 2, 3 of radiator halves 2*a*, 2*b*, 3*a*, 3*b*. Said two pairs 2, 3 of radiator halves 2*a*, 2*b* and 3*a*, 3*b* are clearly visible in particular in FIG. 4. Said two pairs 2, 3 of radiator halves 2*a*, 2*b* and 3*a*, 3*b* are arranged so as to be rotated by 90° with respect to one another, in such a way that the dipole-shaped antenna element arrangement 1 transmits and/or receives in two polarisation planes 4*a*, 4*b* which are arranged perpendicularly to one another. The radiator halves 2*a*, 2*b* and 3*a*, 3*b* are oriented in one radiator plane 5. Said radiator plane 5 is shown by way of example in FIG. 3. Said radiator halves 2*a*, 2*b* and 3*a*, 3*b* can be arranged or are arranged at a distance in front of a reflector 6 and in parallel therewith. The reflector 6 is shown as a dashed line in FIG. 3.

The dipole-shaped antenna element arrangement 1 further comprises a balancing and/or support arrangement 7 which has a first end 7*a* and a second end 7*b*. The second end 7*b* lies opposite the first end 7*a*. The radiator halves 2*a*, 2*b* and 3*a*, 3*b* are arranged at the first end 7*a* of the balancing and/or support arrangement 7. The second end 7*b* of the balancing and/or support arrangement 7 can be attached or is attached to the reflector 6 at least indirectly. An indirect attachment can be present, for example, if the second end 7*b* of the balancing and/or support arrangement 7 is attached to a circuit board, wherein a metal layer of said circuit board simultaneously forms the reflector 6. A separate reflector 6 could also be present underneath the circuit board. A direct attachment to the reflector 6 would be present if the second end 7*b* of the balancing and/or support arrangement 7 is directly attached to the reflector 6. The reflector 6 or the circuit board can also be referred to as a base body. The second end 7*b* of the balancing and/or support arrangement 7 can also be referred to as the base 10. Die balancing and/or support arrangement 7 can also be capacitively coupled to the reflector 6 or the circuit board. This means that an insulating gap or a dielectric is provided between the reflector 6 or the circuit board and the base 10.

The balancing and/or support arrangement 7 consists of and/or comprises a carrier 7*c*. In particular, the balancing and/or support arrangement comprises a support 7*c* for each radiator half 2*a*, 2*b* and 3*a*, 3*b* respectively.

With regard to FIG. 4, there are thus four supports 7*c*. Each of these supports 7*c* extends substantially or exclusively in parallel along a longitudinal axis 8 which penetrates the dipole-shaped antenna element arrangement 1. The supports 7*c* are galvanically connected at the first end 7*a* of the balancing and/or support arrangement 7 to the radiator halves 2*a*, 2*b* and 3*a*, 3*b* respectively. A capacitive coupling of the supports 7*c* to the first end 7*a* of the balancing and/or support arrangement 7 is also possible. A gap 9 is formed between two supports 7*c* in each case, preferably extending from the first end 7*a* to the second end 7*b*, and is used for balancing. The supports 7 are preferably galvanically interconnected at the second end 7*b* of the balancing and/or support arrangement, that is to say, at the base 10 thereof.

A feeding of the dipole-shaped antenna element arrangement 1 takes place preferably in such a way that two cables comprising an inner and an outer conductor respectively are each connected to a pair 2, 3 of the radiator halves 2*a*, 2*b* and 3*a*, 3*b* respectively. The outer conductor of the first cable is connected to a first radiator half 2*a* of the first pair 2. The inner conductor of the first cable, however, is connected to the second radiator half 2*b* of the first pair 2. The outer conductor of the second cable, by contrast, is connected to the first radiator half 3*a* of the second pair 3. The inner conductor of the second cable is correspondingly connected to the second radiator half 3*b* of the second pair 3. The inner conductors therefore cross one another. The connection preferably takes place at the first end 7*a* of the balancing and/or support arrangement 7. It is also possible in principle for the outer conductors to cross one another.

With regard to the feed-in and balancing, reference is made to the documents cited in the introductory part of the description.

With reference to FIG. 4, it is apparent that the radiator halves 2*a*, 2*b* and 3*a*, 3*b* respectively have a substantially square radiator frame 11. The radiator frames 11 of the radiator halves 2*a*, 2*b* and 3*a*, 3*b* respectively have a recess 12 which defines an opening. Each radiator frame 11 consists of four sides wherein, in each case, two sides of a radiator frame 11 are arranged in parallel with two other sides of another radiator frame 11. Arranged between two radiator frames 11 is a gap 13. Said gap 13 transitions into the gap 9 of the balancing and/or support arrangement 7. More specifically, the gap 13 is formed between two inner sides 11*b* of the radiator halves 2*a*, 2*b* and 3*a*, 3*b* respectively which extend in parallel with one another. The feed-in of the radiator halves 2*a*, 2*b* and 3*a*, 3*b* respectively takes place at the point at which two inner sides 11*b* of a radiator half 2*a*, 2*b* and 3*a*, 3*b* respectively meet one another. Each inner side 11*b* is connected to a respective outer side 11*a*. At the point where two outer sides 11*a* meet, the outer corner is preferably bevelled.

The radiator halves 2*a*, 2*b* and 3*a*, 3*b* respectively can also be configured without a recess 12. In FIG. 4, the sides of the recess 12 are arranged in parallel with the sides of the radiator frames 11. The sides of the recess 12 can also be rotated at an angle, in particular of 45° to the sides of the radiator frames 11. In this case, the recesses 12 of the radiator frames 11 are in the shape of a square in plan view. They can however be generally rectangular or have a different cross-section. This means that the recesses 12 can be selected so as to be different within wide ranges in terms of the size and shape thereof.

The first corners of the radiator frames 11 of the radiator halves 2*a*, 2*b* and 3*a*, 3*b* respectively are connected to the first end 7*a* of the individual supports 7*c* of the balancing and/or support arrangement 7. Another corner of the radiator frames 11 of the radiator halves 2*a*, 2*b* and 3*a*, 3*b* respectively, which is opposite, preferably diagonally opposite, the respective first corner, is preferably bevelled. The other corners are preferably bevelled to a lesser extent, or not at all. The bevelled corners are those corners of the radiator frames 11 which are the furthest away from the longitudinal axis 8.

Figure 5A:
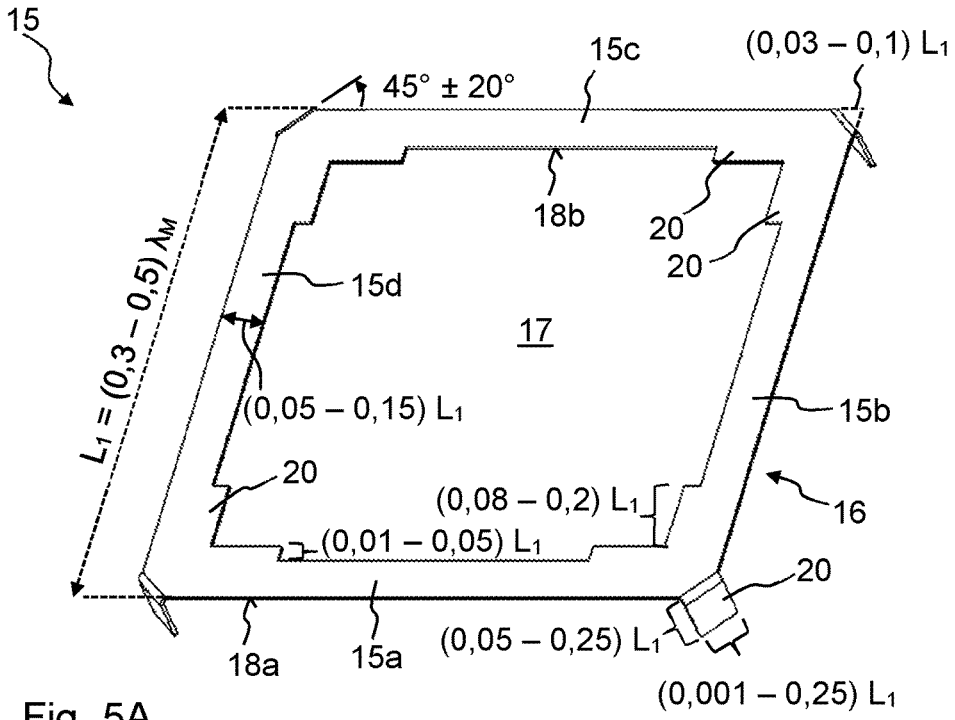
Figure 5B:
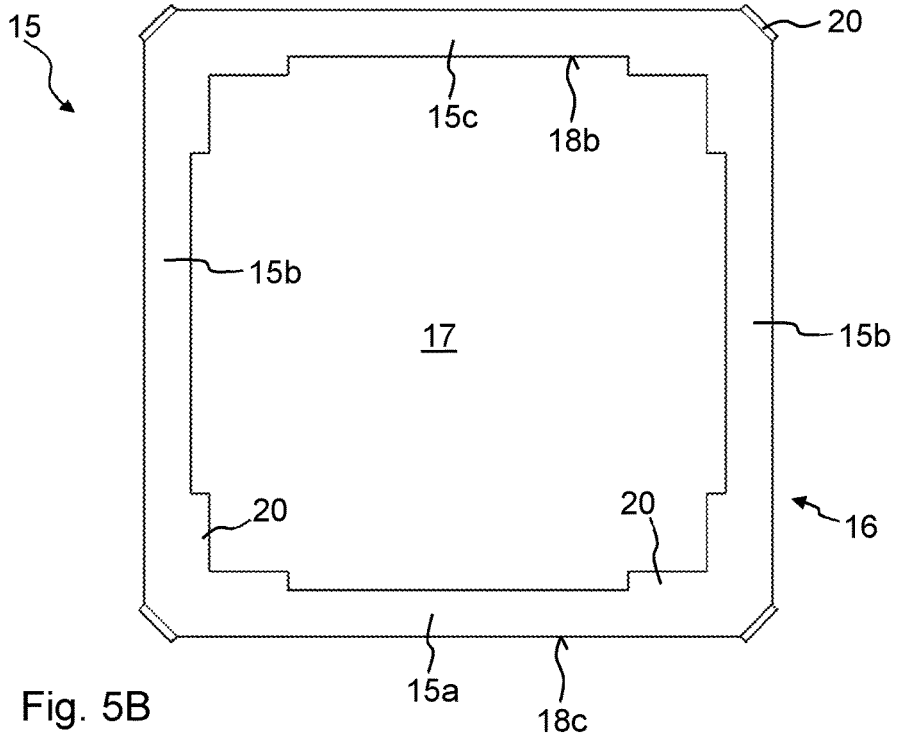

With regard to FIG. 1, a passive beam-shaping frame 15 is shown which is arranged so as to be offset from the radiator halves 2*a*, 2*b* and 3*a*, 3*b* respectively towards the reflector 6, that is to say, towards the base 10. The passive beam-shaping frame 15 consists of a plurality of frame sides 15*a*, 15*b*, 15*c*, 15*d* which form a peripheral frame web 16. The peripheral frame web 16 defines an opening 17. The passive beam-shaping frame 15 is oriented in parallel with the radiator plane 5. In FIGS. 5A and 5B, the passive beam-shaping frame 15 is shown in greater detail. The passive beam-shaping frame 15 is rectangular, in particular square, in plan view. This means that the passive beam-shaping frame 15 preferably has four frame sides 15*a*, 15*b*, 15*c*, 15*d* of equal length. An outer peripheral wall 18*a* of the frame web 16 is bevelled in the region of the corners thereof. This bevel preferably has an angle of 45°. This angle can, however, deviate from the desired 45° by less than ±20°, preferably by less than ±10°.

The passive beam-shaping frame 15 has, in the region of the corners thereof, a broadening 20 of the peripheral frame web 16 thereof, wherein said broadening 20 of the frame web extends in parallel with the radiator plane 5 and/or transversely to the radiator plane 5. By means of such a broadening of the frame web 16, the bandwidth can be substantially increased.

The broadenings 20 of the frame web 16 preferably take place on the inner peripheral wall 18*b* thereof. This means that the frame web 16 extends further in the region of the corners thereof, that is to say closer to the longitudinal axis 8. It is also possible for the broadenings 20 of the frame web 16 to extend on the outer peripheral wall 18*a* thereof. This situation is not shown in the drawings, however.

Figure 5C:
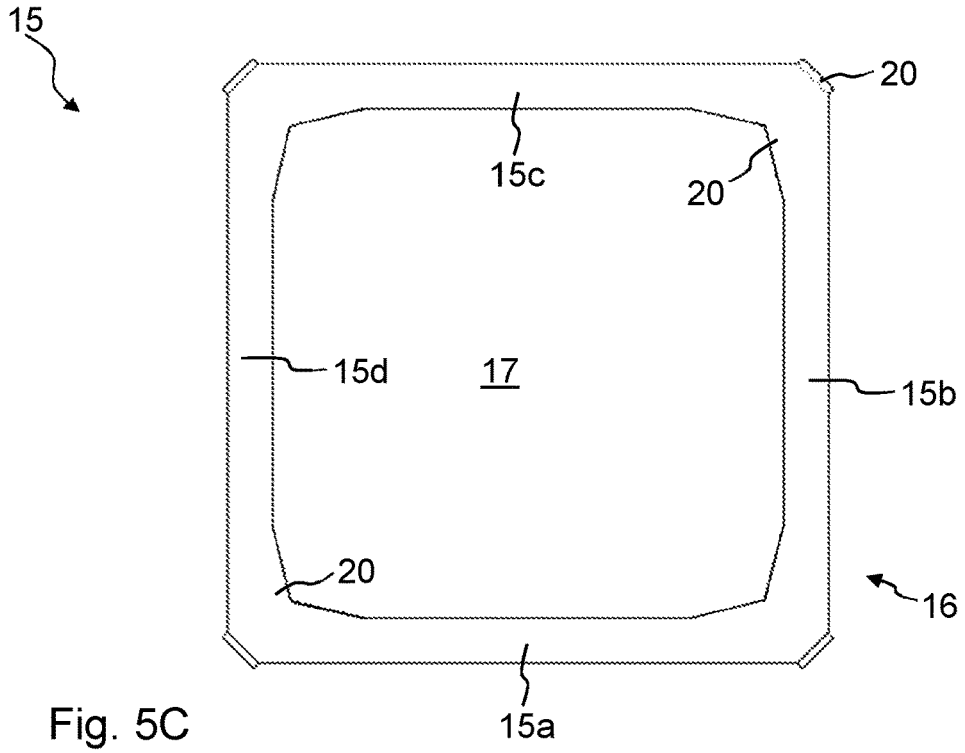

With regard to FIGS. 5A and 5B, the broadenings 20 occur in a tapered manner, that is to say, in one or more steps. In the drawings, the broadenings 20 occur in one step. It is also possible, however, for the broadenings 20 to occur continuously. Such a case is shown in FIG. 5C. The continuous progression can take place over different lengths.

The broadenings 20 preferably occur only in the region of the corners of the passive beam-shaping frame 15. This means that, in plan view, the peripheral frame web is thinner in the middle of the respective frame sides 15*a*, 15*b*, 15*c*, 15*d*, that is to say, is less wide than in the region of the corners thereof.

The broadenings 20 of the frame web 16 are preferably configured the same on all the frame sides 15*a*, 15*b*, 15*c*, 15*d*. This means that the broadenings 20 extend symmetrically to a diagonal through the passive beam-shaping frame 15. The broadenings 20 of the frame web 16, which extend in parallel with the radiator plane 5, occur over a partial length of the individual frame sides 15*a*, 15*b*, 15*c*, 15*d* of the peripheral frame web 16. The partial length is less than 30%, preferably less than 20%, preferably less than 10% but greater than 5% of the length of the individual frame sides 15*a*, 15*b*, 15*c*, 15*d* measured on the outer peripheral wall 18*a*. The width of the broadenings 20 in this case is preferably greater than 10%, preferably greater than 20%, preferably greater than 25% but less than 40%, more preferably less than 35% of the width of the peripheral frame web 16 at the non-broadened point thereof. Preferably, the width of the broadenings 20 is 35% of the width of the peripheral frame web 16 measured at the non-broadened point thereof. The non-broadened point of the peripheral frame web 16 is preferably the point in the middle of each frame side 15*a*, 15*b*, 15*c*, 15*d*. Said point is preferably at an equal distance from both corners. If the frame sides 15*a*, 15*b*, 15*c*, 15*d* differ at this point in terms of the width thereof, the mean value of said width can be used.

As previously described, in each case two frame sides 15*a*, 15*b*, 15*c*, 15*d* of the frame web 16 extend towards one another forming a corner, wherein the broadenings 20, which extend in parallel with the radiator plane 5, each start at an equal distance from the corners on the individual frame sides 15*a*, 15*b*, 15*c*, 15*d* of the peripheral frame web 16 over a partial length of the respective frame sides 15*a*, 15*b*, 15*c*, 15*d*.

The passive beam-shaping frame 15 is preferably configured in one piece. A multi-part configuration is also conceivable. The peripheral frame web 16 is preferably configured without interruptions. Said web could also have interruptions or recesses which extend over a part of the width thereof on one or more frame sides 15*a*, 15*b*, 15*c*, 15*d* or are formed there. Said interruptions could extend in part into the respective frame sides 15*a*, 15*b*, 15*c*, 15*d* or penetrate said sides in full.

With regard to FIGS. 1 and 2, the corners of the radiator frames 11 of the radiator halves 2*a*, 2*b* and 3*a*, 3*b* respectively which face towards the corners of the passive beam-shaping frame 15 are bevelled. The sides of the radiator frames 11 of the radiator halves 2*a*, 2*b* and 3*a*, 3*b* respectively are arranged in parallel with the frame sides 15*a*, 15*b*, 15*c*, 15*d* of the frame web.

With regard to FIGS. 1, 2, 3 and 5A, it should also be recognised that a broadening 20 is additionally formed transversely to the radiator plane 5. Said broadening 20 transversely to the radiator plane 5 can be configured alternatively or additionally to the broadening 20 which is formed in parallel with the radiator plane 5. The broadening 20 transversely to the radiator plane 5 is preferably oriented perpendicularly to the radiator plane 5. A deviation from this perpendicular of less than ±40°, preferably less than ±20°, preferably less than ±15°, more preferably less than ±10°, more preferably of ±5° is also possible. The broadening 20 which is oriented perpendicularly to the radiator plane 5 is located at the corners of the outer peripheral wall 18*a* of the frame web 16. Said corners are bevelled over a particular length, wherein the broadening 20 is provided transversely to the radiator plane 5 preferably over the entire bevelling of the corners (it is also possible for this to occur over a specific partial length of the bevelling of the corners). In this case, the corners of the outer peripheral wall 18*a* of the frame web 16 are bevelled over a length which preferably corresponds to approximately double the width of the frame web 16 at the non-broadened points thereof. The broadenings 20 extend preferably perpendicularly to the radiator plane 5, over a length which also corresponds approximately to the width of the frame web 16 at the non-broadened points thereof.

In the embodiment shown, the broadening 20 extends transversely to the radiator plane 5 towards the base 10 of the balancing and/or support arrangement 7. The broadening 20 transversely to the radiator plane 5 therefore extends towards the reflector 6. Preferably, the passive beam-shaping frame 15 has a broadening 20 transversely to the radiator plane 5 at each of the corners thereof.

The passive beam-shaping frame 15 is preferably manufactured in one piece by means of a stamping process. The same also applies to the two pairs 2, 3 of radiator halves 2*a*, 2*b* and 3*a*, 3*b* respectively which are manufactured in a stamping process in one piece together with the balancing and/or support arrangement 7. These can still be formed by an additional bending process.

Figure 6A:
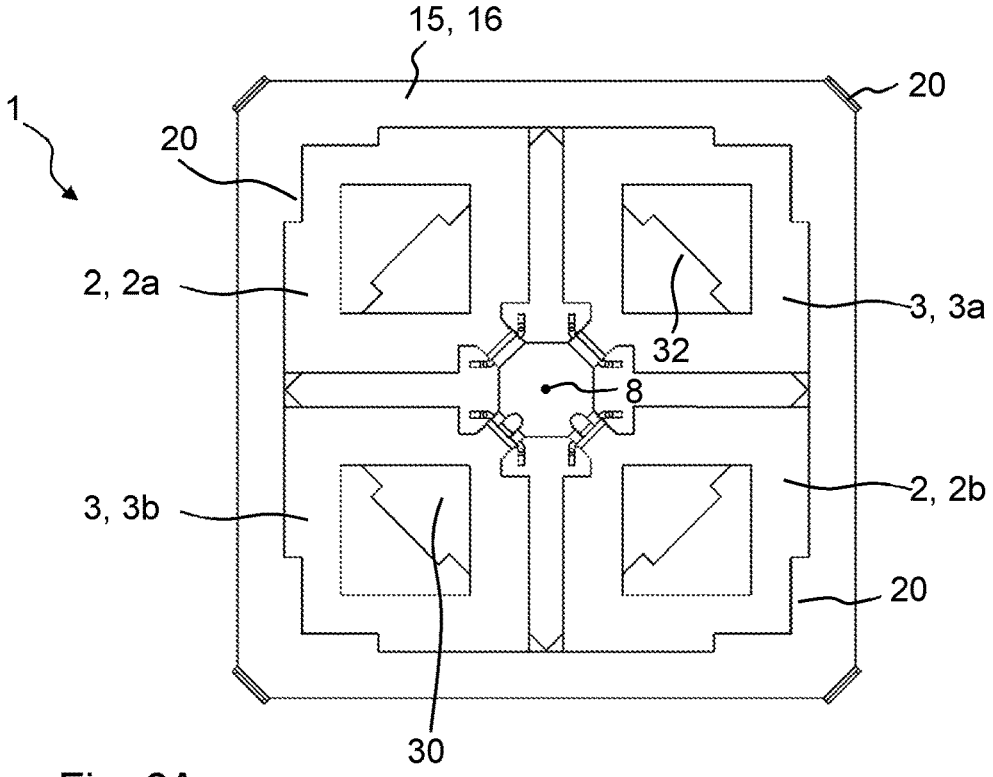
Figure 6B:
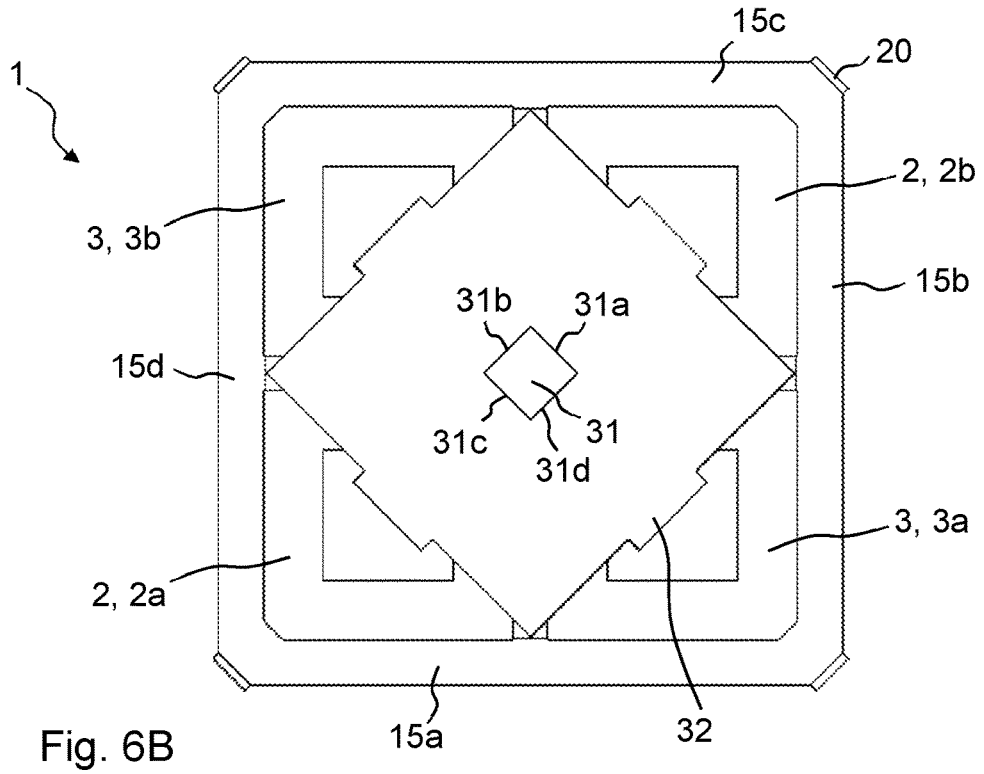

With regard to FIGS. 6A and 6B which show a view from above and a view from below of the dipole-shaped antenna element arrangement 1, it is apparent that at least part of the radiator halves 2*a*, 2*b* and 3*a*, 3*b* respectively, that is to say part of the radiator frame 11, overlaps at least in part or in full with the broadenings 20 of the frame web 16 which are configured on the inner peripheral wall 18*b* thereof. Preferably, the radiator frames 11 of the radiator halves 2*a*, 2*b* and 3*a*, 3*b* respectively end flush with the frame web 16 of the passive beam-shaping frame 15 at the non-broadened points of the frame web 16.

With regard to FIGS. 1, 2, 3, 6B and 7, a director 30 is additionally shown which also contributes to increasing the bandwidth. The director 30, as well as the passive beam-shaping frame 15, is oriented in parallel with the radiator plane 5. The radiator halves 2*a*, 2*b* and 3*a*, 3*b* respectively are arranged closer to the reflector 6, that is to say, closer to the base of the balancing and/or support arrangement 7 than the director 30. This means that the radiator halves 2*a*, 2*b* and 3*a*, 3*b* respectively are arranged between the passive beam-shaping frame 15 and the director 30. The director 30 is not necessarily provided.

The outer sides 30*a*, 30*b*, 30*c*, 30*d* of the director 30 are arranged so as to be rotated by an angle of between 30° and 60°, and in particular by 45° to the outer sides 11*a* and/or inner sides 11*b* of the radiator halves 2*a*, 2*b*, and 3*a*, 3*b* respectively. This means that, seen in a plan view, the corners of the director 30 end in the middle of the gap 13 which separates the individual radiator halves 2*a*, 2*b* and 3*a*, 3*b* respectively from one another. The outer sides 30*a*, 30*b*, 30*c*, 30*d* of the director 30 can be arranged, seen in a plan view, in parallel with a diagonal through the radiator halves 2*a*, 2*b* and 3*a*, 3*b* respectively.

The outer sides 30*a*, 30*b*, 30*c*, 30*d* of the director 30 are also arranged so as to be rotated by angle of between 30° and 60° to the frame sides 15*a*, 15*b*, 15*c*, 15*d* of the passive beam-shaping frame 15. The angle can also be between 35° and 55°, preferably between 40° and 50°, and more preferably can be 45°.

The director 30 is rectangular, in particular square. In the centre thereof, through which the longitudinal axis 8 of the dipole-shaped antenna element arrangement 1 extends, the director 30 has a recess 31. The shape of the recess 31 substantially corresponds to the cross-sectional shape of the director 30. In this case, the recess 31 is rectangular, in particular square, the sides of the recess 31*a*, 31*b*, 31*c*, 31*d* of the director 30 extending in parallel with the outer sides 30*a*, 30*b*, 30*c*, 30*d* of the director 30. They can also be offset by 45° to the outer sides 30*a*, 30*b*, 30*c*, 30*d*. Another rotation, for example by an angle of between 30° and 60°, is also possible.

The recess 31 can also be another shape. It is conceivable for the recess 31 to be in the shape, for example, of a circle, an oval or a regular or irregular n-polygon.

The director 30 also preferably comprises on each outer side 30*a*, 30*b*, 30*c*, 30*d* a tongue 32 protruding outwardly—in parallel with the radiator plane 5. The protruding tongue 32 is preferably provided in the middle of each outer side 30*a*, 30*b*, 30*c*, 30*d* of the director 30. Said tongue could also be configured so as to be offset from the middle.

There can also be a plurality of tongues 32 which are arranged on the same outer side 30*a*, 30*b*, 30*c*, 30*d* of the director 30. Not every outer side 30*a*, 30*b*, 30*c*, 30*d* of the director must have a tongue 32. It would also be sufficient for only two mutually opposed outer sides 30*a*, 30*b*, 30*c*, 30*d* (these are arranged in parallel with one another) to each have a protruding tongue 32. With regard to FIG. 6B, it is also apparent that, in a plan view of the director 30, an outer side 30*a*, 30*b*, 30*c*, 30*d* of each tongue 32 extends in parallel with a diagonal extending through each radiator half 2*a*, 2*b* and 3*a*, 3*b* respectively.

The director 30 is preferably also configured in one piece. The director 30 can preferably be manufactured in a stamping process. Both the passive beam-shaping frame 15 and the director 30—as well as the radiator halves 2*a*, 2*b* and 3*a*, 3*b* respectively—are formed from an electrically conductive material or are covered with such a material.

What is not shown is that the passive beam-shaping frame 15 is held, together with the director 30, galvanically separated via at least one combined holding and spacing element, supported on one or all of the radiator halves 2*a*, 2*b* and 3*a*, 3*b* respectively and at a distance therefrom. The combined holding and spacing element is preferably configured in one piece. The combined holding and spacing element can also engage in the balancing and/or support arrangement 7 and support itself thereon, by means of which the passive beam-shaping frame 15 and the director 30 are held at a distance.

Also indicated in FIGS. 3, 5A and 7 are dimensions. FIG. 3 shows that the distance between the director 30 and the radiator halves 2*a*, 2*b* and 3*a*, 3*b* respectively corresponds to between 5% and 15% of the wavelength of the centre frequency. If the dipole-shaped antenna element arrangement is used, for example, in a frequency range of 700 to 900 MHz, then the centre frequency would be 800 MHz. The distance between the radiator halves 2*a*, 2*b* and 3*a*, 3*b* respectively and the passive beam-shaping frame 15 corresponds to between 0.5% and 18% of the wavelength of the centre frequency. The spacing can be selected as desired between these regions.

The dimensions of the passive beam-shaping frame 15 will now be described in greater detail in relation to FIG. 5A. The angle by which the corners of the frame sides 15*a*, 15*b*, 15*c*, 15*d* of the frame web 16 can be bevelled is preferably 45°. A deviation of less than ±20°, preferably less than ±15°, more preferably less than ±10°, more preferably less than ±5° is also conceivable.

The further length details relate to the side length $L_1$. The length of a frame side 15*a*, 15*b*, 15*c*, 15*d* (on the outer peripheral wall 18*a*) without a bevel is in the range of 30% to 50% of the wavelength of the centre frequency. Preferably, a value of 40% of the wavelength of the centre frequency is selected. This specific length $L_1$ is used to define the further dimensions. For example, the width of the frame web 16 at the non-broadened points thereof is 5% to 15%, preferably 10% of the specific length $L_1$. The width of the broadenings 20 which lie on the inner side 18*b* of the frame web 16 is approximately 1% to 5%, preferably 2% to 4%, more preferably 3% of the specific length $L_1$. The partial length over which the broadenings 20 extend on the inner side 18*b* of the frame web 16 is approximately 8% to 20%, preferably 12% to 16%, more preferably 14% of the specific length $L_1$. The expression "in the region of the corners thereof" should be understood as the region of the frame web 16 of the passive beam-shaping frame 15 which extends from the respective corners on the inner side 18*b* along the partial length along the frame sides 15*a*, 15*b*, 15*c*, 15*d*. This partial length is between 8% and 20%, preferably between 10% and 19%, more preferably between 12% and 17% and more preferably corresponds to 15% of the specific length $L_1$.

The broadenings 20 which extend transversely to the radiator plane 5 extend towards the reflector 6 or towards the director 30 in a length which corresponds to at least 4% of the specific length $L_1$ and preferably is greater than 5%, or is greater than 8%, or is greater than 10%, or is greater than 12%, or is greater than 14%, or is greater than 16%, or is greater than 18%, or is greater than 20%, or is greater than 22%, or is greater than 24% of the specific length $L_1$. In this case, the length is preferably less than 25% and more preferably less than 22%, or less than 20%, or less than 18%, or less than 15%, or less than 13%, or less than 11% of the specific length $L_1$.

The width of the broadening 20 which extends towards the reflector 6 or towards the director 30 has a length which corresponds to at least 0.05% of the specific length $L_1$ and more preferably is greater than 0.1%, or is greater than 0.3% or is greater than 0.7%, or is greater than 1%, or is greater than 2%, or is greater than 5%, or is greater than 7%, or is greater than 9%, or is greater than 11%, or is greater than 12%, or is greater than 15%, or is greater than 18%, or is greater than 20%, or is greater than 22%, or is greater than 22% of the specific length $L_1$. In this case, the length is preferably less than 25% and more preferably less than 22%, or less than 20%, or less than 18%, or less than 16%, or less than 14%, or less than 12%, or less than 10%, or less than 8%, or less than 6%, or less than 4% of the specific length $L_1$.

Due to the bevelling at the corners of the frame sides 15*a*, 15*b*, 15*c*, 15*d*, these are shortened by a particular length. Said length lies in the range of 3% to 10%, more preferably in the range of 5% to 7% and more preferably it is 6% of the specific length $L_1$.

The broadenings 20 which extend transversely, preferably perpendicularly to the radiator plane 5 can also be arranged on an inner side 18*b* of the frame web 16.

The passive beam-shaping frame 15 is thinner in terms of the dimensions thereof along the longitudinal direction 8 than in terms of the width thereof in parallel with the radiator plane 5. The thickness of the frame web 16 in parallel with the radiator plane 5 is therefore greater than the extent thereof along the longitudinal axis 8. The same also applies to the director 30 and the radiator halves 2*a*, 2*b* and 3*a*, 3*b* respectively.

In FIG. 7, it is shown that a further specific length $L_2$ corresponds to the side 30*a*, 30*b*, 30*c*, 30*d* of the director 30. Said further specific length $L_2$ is preferably in the range between 15% and 35%, more preferably in the range between 20% and 30%, and more preferably is 25% of the wavelength of the centre frequency of the dipole-shaped antenna element arrangement 1.

In this case, the tongues 32 extend over a length of 10% to 50%, preferably from 20% to 40% and correspond to approximately 30% of the further specific length $L_2$. The tongues 32 extend outwardly away from the director 30 and thus have a thickness in parallel with the radiator plane 5 which lies in a range of 1% to 10%, preferably in the range of 3% to 7%, and more preferably is 5% of the further specific length $L_2$.

The sides 31*a*, 31*b*, 31*c*, 31*d* of the recess 31 have a length which lies in the range of 10% to 25%, preferably in the range of 15% to 20%, and more preferably is 17% of the further specific length $L_2$.

FIG. 8A to 8E show different views of a further passive beam-shaping frame 15 according to a further embodiment. The frame sides 15*a*, 15*b*, 15*c*, 15*d* of the passive beam-shaping frame 15 each comprise a vane 40 in the middle thereof. Preferably, each frame side 15*a*, 15*b*, 15*c*, 15*d* comprises such a vane 40. More preferably, there is exactly one vane 40 per frame side 15*a*, 15*b*, 15*c*, 15*d*, and therefore the passive beam-shaping frame 15, with four frame sides 15*a*, 15*b*, 15*c*, 15*d*, has exactly four vanes 40.

Figure 8A:
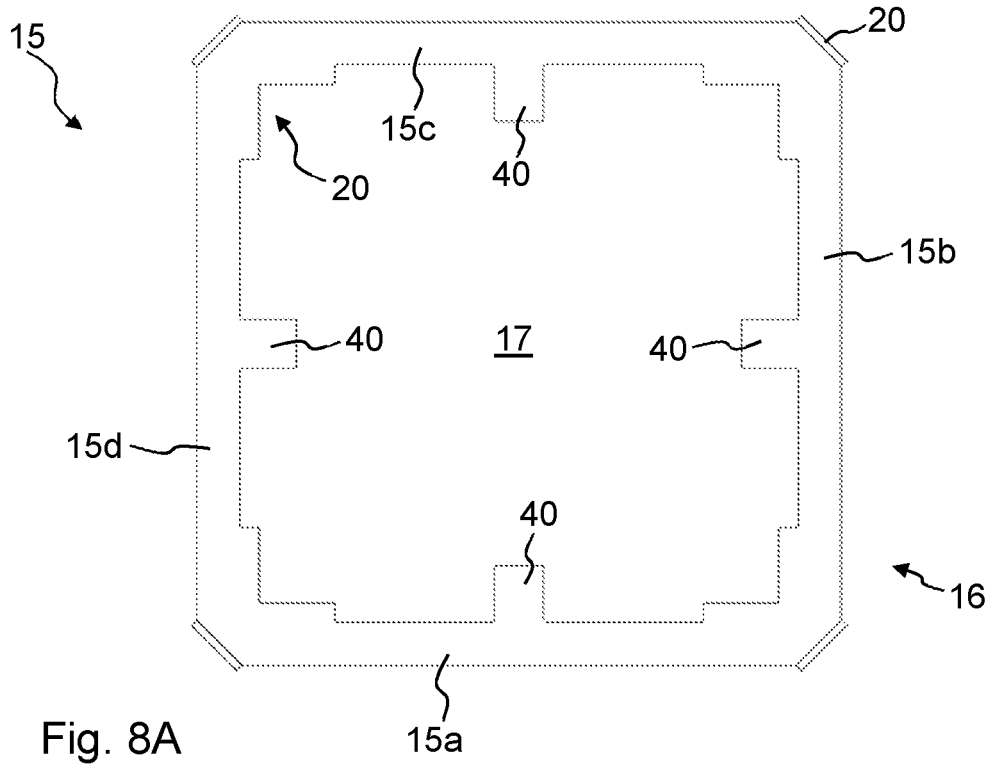
Figure 8B:
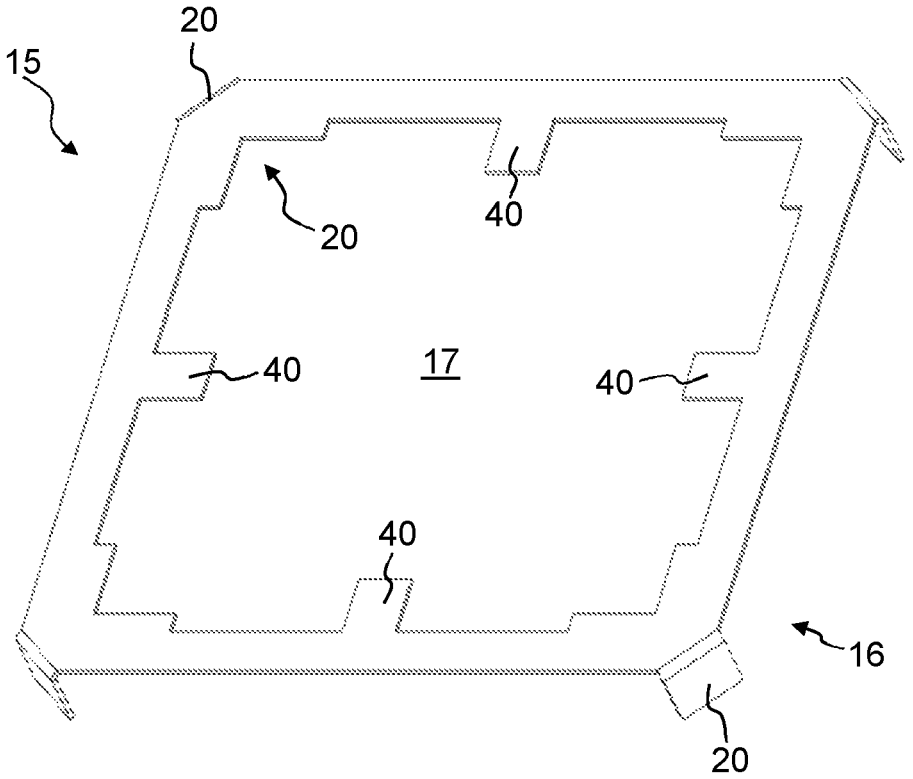
Figure 8C:
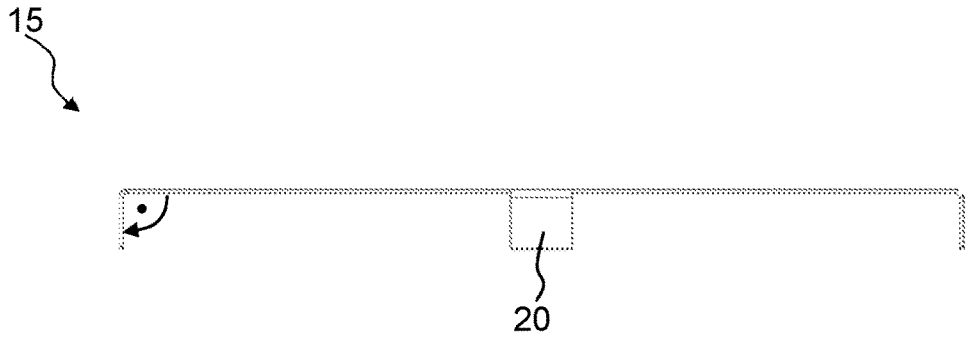
Figure 8D:
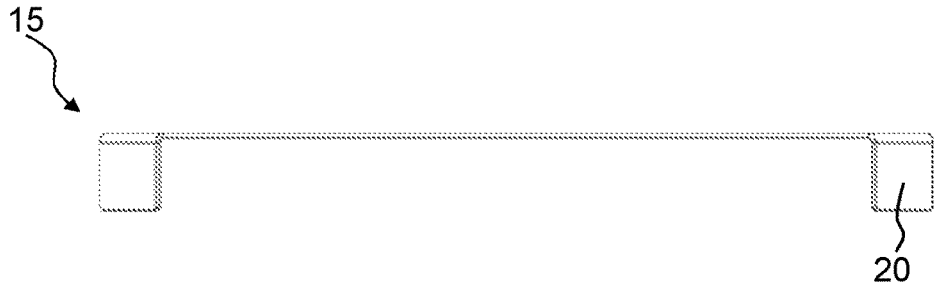
Figure 8E:
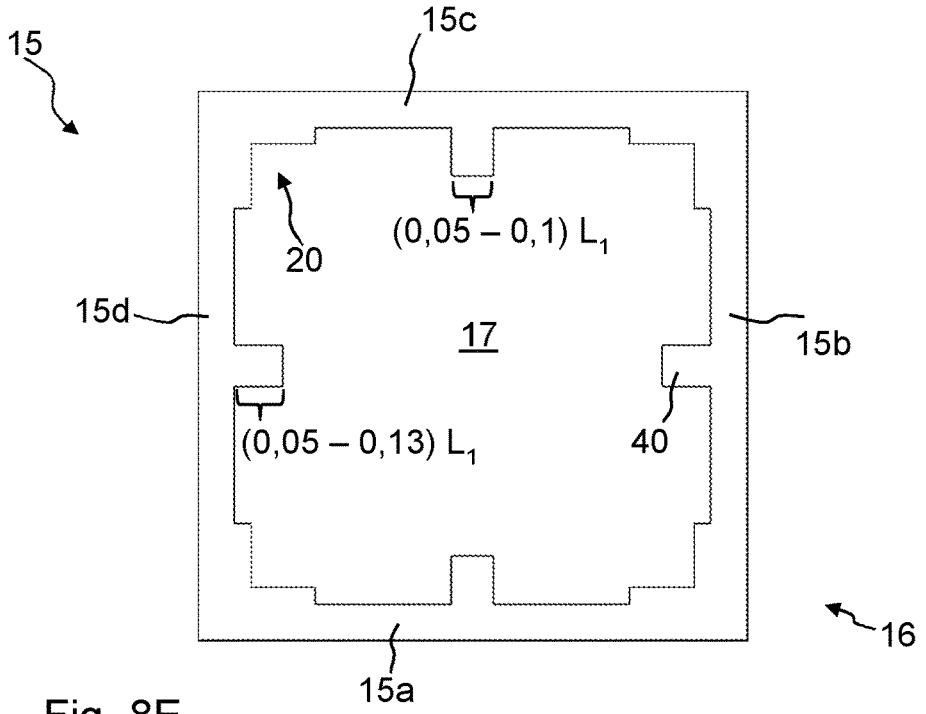

As can be seen in FIGS. 8A, 8B and 8E, the vanes 40 extend approximately in parallel with the radiator plane 5.

The passive beam-shaping frame 15 is preferably configured in one piece with the frame sides 15*a*, 15*b*, 15*c*, 15*d* thereof. Said frame can be manufactured, for example, in a single stamping process, wherein the broadenings 20 which extend transversely to the radiator plane 5 are manufactured in a further bending process. Each vane 40 also belongs to the respective frame sides 15*a*, 15*b*, 15*c*, 15*d*. This means that the passive beam-shaping frame 15 is formed from one combined part in one piece together with the respective frame sides 15*a*, 15*b*, 15*c*, 15*d* and the vanes 40. It is also possible in principle that the vanes 40 could be attached by means of a soldering or welding process to the frame sides 15*a*, 15*b*, 15*c*, 15*d*.

The vanes 40 could also extend transversely to the radiator plane 5. In particular, said vanes could extend at an angle of preferably 90° to the radiator plane 5. A deviation from this 90° by less than ±30°, preferably by less than ±20°, more preferably by less than ±15°, more preferably by less than ±10° and more preferably by less than ±5° is also possible.

The vanes 40 are preferably mounted in the middle of each frame side 15*a*, 15*b*, 15*c*, 15*d*. It is also possible that the vanes 40 can be arranged slightly away from the middle of the frame sides 15*a*, 15*b*, 15*c*, 15*d*. In this case, the vanes 40 should be arranged at a distance from the middle of the frame side 15*a*, 15*b*, 15*c*, 15*d* preferably by less than 20%, more preferably by less than 10%, more preferably by less than 5% of the length of the respective frame side 15*a*, 15*b*, 15*c*, 15*d*.

The vanes 40 preferably extend from the respective frame side 15*a*, 15*b*, 15*c*, 15*d* towards the opening 17 which the frame web 16, that is to say, the passive beam-shaping frame 15 surrounds. This means that the vanes 40 preferably extend from an inner peripheral wall 18*b* of the frame web 16, that is to say, the passive beam-shaping frame 15, towards the opening 17. In this case, the vanes 40 face towards the longitudinal axis 8 which penetrates preferably the centre of the passive beam-shaping frame 15.

A plurality of vanes 40 can also be arranged on the respective frame side 15*a*, 15*b*, 15*c*, 15*d*. Said vanes are preferably arranged at an equal distance from one another and at an equal distance from the ends of the respective frame side 15*a*, 15*b*, 15*c*, 15*d*. The number of vanes 40 on each frame side 15*a*, 15*b*, 15*c*, 15*d* can differ for all frame sides 15*a*, 15*b*, 15*c*, 15*d* or from frame side 15*a*, 15*b*, 15*c*, 15*d* to frame side 15*a*, 15*b*, 15*c*, 15*d*.

Alternatively, it is also possible for the vanes 40 to also extend outwardly away from an outer peripheral wall 18*a* of the respective frame side 15*a*, 15*b*, 15*c*, 15*d* of the frame web 16 and to not project into the opening 17 which the frame web 16 surrounds.

In addition thereto, it is also possible for some vanes 40, or at least one vane 40, to extend away from the inner peripheral wall 18*b* of the frame web 16, whereas other vanes 40, or at least one other vane 40, extend outwardly away from the outer peripheral wall 18*a* of the frame web 16. Vanes 40 which are arranged on mutually opposed frame sides 15*a*, 15*b*, 15*c*, 15*d* preferably extend away from the same (inner or outer) peripheral wall 18*a*, 18*b* of the frame web 26. It is also possible for no vane 40 to be formed on a frame side 15*a*, 15*b*, 15*c*, 15*d*. In such a case, this preferably also applies to the frame side 15*a*, 15*b*, 15*c*, 15*d* lying opposite said frame side 15*a*, 15*b*, 15*c*, 15*d*.

The vanes 40 have a width which corresponds to approximately 5% to 10%, preferably 6% to 9%, more preferably 7% to 8% of the specific length $L_1$. The width of the vanes 40 is the side of the vanes 40 which extends approximately in parallel with the respective frame side 15*a*, 15*b*, 15*c*, 15*d* on which the vanes 40 are arranged. In contrast thereto, a length of the vanes 40 is understood to be a length with which they extend towards the opening 17 or outwardly from the frame web 16. Said length is approximately 5% to 13%, preferably 7% to 11%, more preferably 8% to 10% of the specific length $L_1$ and more preferably corresponds to 9% of the specific length $L_1$ (see FIG. 8E). This means that, seen in plan view, the vanes 40 are, for example, rectangular, preferably square. The vanes 40 can also be trapezoid or semicircular or half-oval, and/or the edge contour of the vanes 40 can be configured to be n-polygonal.

With regard to FIG. 8E, it is apparent that the passive beam-shaping frame 15 has no broadening 20 in the region of the corners thereof that extends transversely or perpendicularly to the radiator plane 5. The passive beam-shaping frame 15 has no bevels on the outer peripheral wall 18*a* thereof in the region of the corners thereof. This means that two frame sides 15*a*, 15*b*, 15*c*, 15*d* extend at an angle of approximately 90° to one another. Preferably, however, the passive beam-shaping frame 15 does have a bevel on the outer peripheral wall 18*a* thereof in the region of the corners thereof, which bevel adjoins the respective frame sides 15*a*, 15*b*, 15*c*, 15*d* approximately at an angle of 45°.

FIGS. 9A and 9B show different three-dimensional views of the dipole-shaped antenna element arrangement 1 according to a further embodiment. The dipole-shaped antenna element arrangement 1 comprises a passive beam-shaping frame 15, as shown, for example, in FIGS. 8A and 8B. This passive beam-shaping frame 15 also comprises, in addition to broadenings 20 which extend in parallel with the radiator plane 5 and transversely, preferably perpendicularly, to the radiator plane 5, vanes 40 which are formed in the middle of each frame side 15*a*, 15*b*, 15*c*, 15*d* and extend in parallel with the radiator plane 5 into the opening 17 which is surrounded by the passive beam-shaping frame 15.

In this embodiment, the dipole-shaped antenna element arrangement 1 does not comprise a director 30. Rather, the dipole-shaped antenna element arrangement 1 comprises a plurality of metal strips 50 which are oriented in parallel with the radiator plane 5. In this case, both the passive beam-shaping frame 15 and the radiator halves 2*a*, 2*b*, 3*a*, 3*b* are arranged lying closer to the base 10 or the reflector 6 than the metal strips 50.

The metal strips 50 preferably have a rectangular or rectangle-like shape. In this case, the corners can also be rounded. The metal strips 50 are preferably multiple times longer than they are wide. Seen in plan view, the metal strips 50 are arranged on the dipole-shaped antenna element arrangement 1 in the region of the outer sides 11*a* of the radiator halves 2*a*, 2*b*, 3*a*, 3*b*. With regard to FIG. 9D to 9F, which show a plan view of the dipole-shaped antenna element arrangement 1, it is clear that each metal strip 50 extends approximately in parallel with in each case two outer sides 11*a* of two adjacent radiator halves 2*a*, 3*a* and 3*a*, 2*b* and 2*b*, 3*b* and 3*b*, 2*a* respectively. Preferably, each metal strip 50 also extends in parallel with one frame side 15*a*, 15*b*, 15*c*, 15*d* of the frame web 16 of the passive beam-shaping frame 15.

The metal strips 50 are galvanically separated both from the radiator halves 2*a*, 2*b*, 3*a*, 3*b* and also from the passive beam-shaping frame 15.

Preferably, there are four metal strips 50. Each of these metal strips 50 is arranged in the region of two outer sides 11*a* of two adjacent radiator halves 2*a*, 3*a* and 3*a*, 2*b* and 2*b*, 3*b* and 3*b*, 2*a* respectively. The middle of each metal strip 50 is located approximately at the level of a middle of the gap 13 between the adjacent radiator halves 2*a*, 3*a* and 3*a*, 2*b* and 2*b*, 3*b* and 3*b*, 2*a* respectively. This means that each metal strip 50 is assigned in equal parts to each of the two adjacent radiator halves 2*a*, 3*a* and 3*a*, 2*b* and 2*b*, 3*b* and 3*b*, 2*a* respectively. The metal strip 50 therefore extends approximately in parallel with two outer sides 11*a* of two adjacent radiator halves 2*a*, 3*a* and 3*a*, 2*b* and 2*b*, 3*b* and 3*b*, 2*a* respectively, which belong to different pairs 2, 3 of radiator halves 2*a*, 2*b*, 3*a*, 3*b*.

With regard to FIGS. 9A, 9B and 9D to 9F, it is apparent that each metal strip 50 is arranged in such a way that it does not overlap with a recess 12 situated within the radiator halves 2*a*, 2*b*, 3*a*, 3*b*. In another embodiment, it is possible for the metal strips 50 to be at a further distance from a longitudinal axis 8 than the radiator halves 2*a*, 2*b*, 3*a*, 3*b*.

Figure 9D:
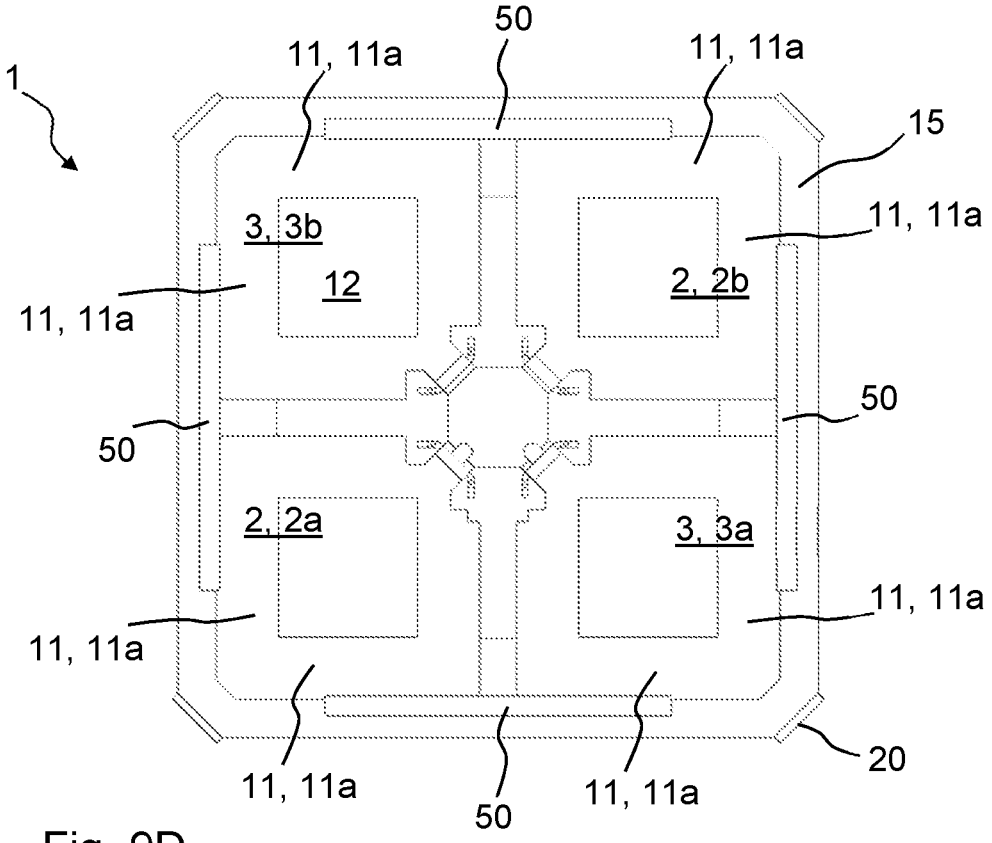

With regard to FIG. 9D, it is shown in a plan view of the dipole-shaped antenna element arrangement 1 that at least part of the width of each metal strip 50 overlaps the two outer sides 11*a* of the corresponding adjacent radiator halves 2*a*, 3*a* and 3*a*, 2*b* and 2*b*, 3*b* and 3*b*, 2*a* respectively. In this embodiment, the metal strips 50 overlap the respective outer sides 11*a* over a partial width that is less than 50% of the width of the metal strips 50. The metal strips 50 could also be arranged completely above the two outer sides 11*a* and overlap said sides with the full width thereof. In this regard, FIG. 9C shows a side view of the dipole-shaped antenna element arrangement 1. The metal strips 50 and the radiator halves 2*a*, 2*b*, 3*a*, 3*b* are at a different distance from the base 10 and from the passive beam-shaping frame 15. It is possible for preferably two metal strips 50 to be arranged in each case in different planes above the radiator halves 2*a*, 2*b*, 3*a*, 3*b*. This means that the distance of the metal strips 50 from the base 10 is different from metal strip 50 to metal strip 50, in particular from metal strip pair (comprising two or at least two metal strips) to metal strip pair.

Figure 9E:
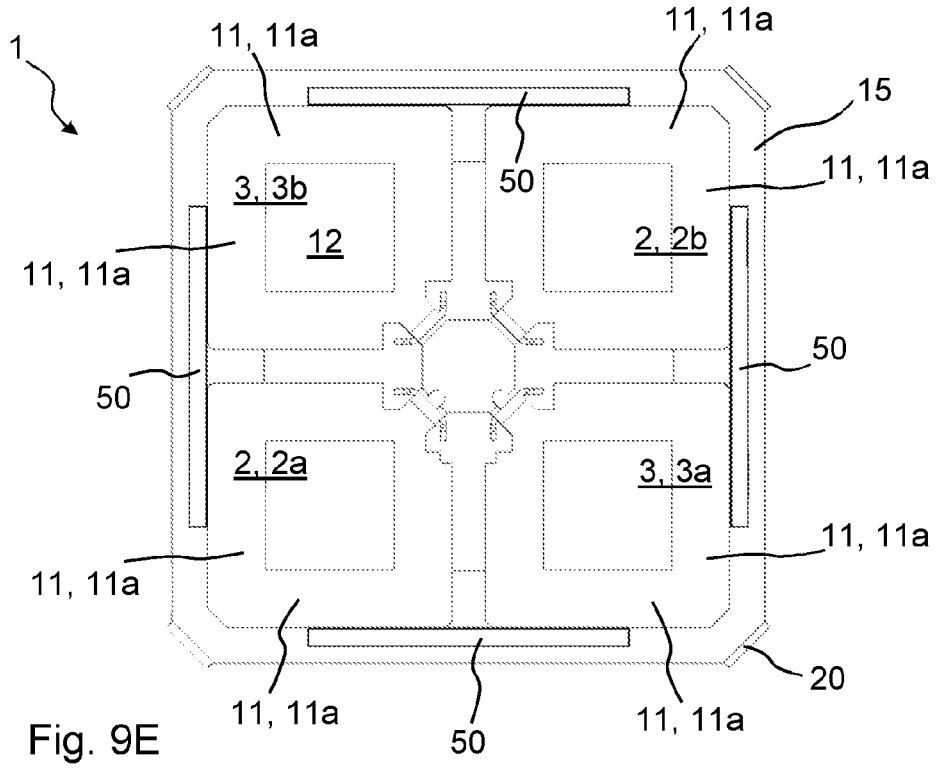

However, this is different in FIG. 9E. In a plan view of the dipole-shaped antenna element arrangement 1, the metal strips 50 directly abut two outer sides 11*a* of two adjacent radiator halves 2*a*, 3*a* and 3*a*, 2*b* and 2*b*, 3*b* and 3*b*, 2*a* respectively without overlap. The outer edges of the metal strips 50 and of the respective outer sides 11*a* lie in the same plane, wherein the plane is again oriented perpendicularly to the radiator plane 5. The metal strips 50 are arranged at a distance from the respective radiator halves 2*a*, 2*b*, 3*a*, 3*b* only in the direction of the longitudinal axis 8.

Figure 9F:
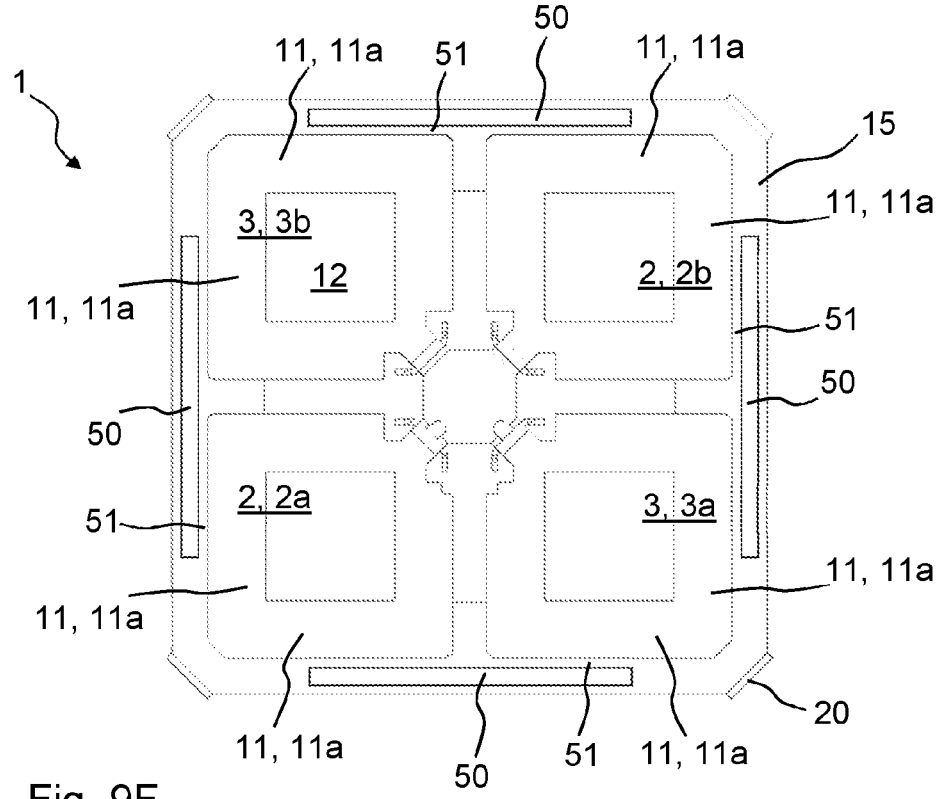

By contrast, a further embodiment is shown in FIG. 9F. In a plan view of the dipole-shaped antenna element arrangement 1, the metal strips 50 are arranged at a distance from both the respective outer sides 11*a* of two adjacent radiator halves 2*a*, 3*a* and 3*a*, 2*b* and 2*b*, 3*b* and 3*b*, 2*a* respectively without overlap in the direction of the longitudinal axis 8. In plan view, a gap 51 remains between the metal strip 50 and the two adjacent radiator halves 2*a*, 3*a* and 3*a*, 2*b* and 2*b*, 3*b* and 3*b*, 2*a* respectively. In this case, the metal strips 50 are arranged at a further distance from the longitudinal axis 8 than the radiator halves 2*a*, 2*b*, 3*a*, 3*b*. It is apparent in a plan view that the metal strips 50 do not extend further outwardly from the dipole-shaped antenna element arrangement 1 than the passive beam-shaping frame 15.

Essentially, in the plan view of the dipole-shaped antenna element arrangement 1, the metal strips 50 can also be arranged in such a way that they do not overlap the radiator halves 2*a*, 2*b*, 3*a*, 3*b*, the metal strips 50 preferably being at a further distance (on average) from the longitudinal axis 8 than the outer sides 11*a* of the radiator halves 2*a*, 2*b*, 3*a*, 3*b*. In this case, it is possible for an inner edge of the metal strips 50, which is arranged closer to the longitudinal axis 8 than an outer edge of the metal strips 50, to end flush with the outer edges of the outer sides 11*a* of the radiator halves 2*a*, 2*b*, 3*a*, 3*b*.

In a plan view, the metal strips 50 lie above the passive beam-shaping frame 15. FIG. 9C shows that the distance of the metal strips 50 from the radiator halves 2*a*, 2*b*, 3*a*, 3*b* corresponds to from 0.2% to 5%, preferably 0.5% to 4%, more preferably 0.7% to 3% of the wavelength of the centre frequency and preferably corresponds to 1% of the wavelength of the centre frequency. The distance of the metal strip 50 from the radiator halves 2*a*, 2*b*, 3*a*, 3*b* is thus smaller than the distance of the director 30 from the radiator halves 2*a*, 2*b*, 3*a*, 3*b* by at least a factor of three, and therefore the dipole-shaped antenna element arrangement 1 can be configured to be substantially more compact but nevertheless having just as much bandwidth. The distance of the radiator halves 2*a*, 2*b*, 3*a*, 3*b* from the passive beam-shaping frame 15 corresponds approximately to that described by reference to FIG. 3. The distance between the metal strips 50 and the radiator halves 2*a*, 2*b*, 3*a*, 3*b* is thus significantly smaller than the distance between the radiator halves 2*a*, 2*b*, 3*a*, 3*b* and the passive beam-shaping frame 15. In plan view, some metal strips 50 could overlap the respective adjacent radiator halves 2*a*, 3*a* and 3*a*, 2*b* and 2*b*, 3*b* and 3*b*, 2*a* respectively or could define said halves without overlap or could be at a distance therefrom by a gap 51. In this case, the metal strips 50 can be arranged differently relative to one another than relative to the respective radiator halves 2*a*, 2*b*, 3*a*, 3*b*. It is also possible for the metal strips 50 to be wider and, in a plan view to protrude outwardly beyond the passive beam-shaping frame 15. In plan view, the metal strips 50 preferably do not protrude beyond the passive beam-shaping frame 15.

Figure 9G:
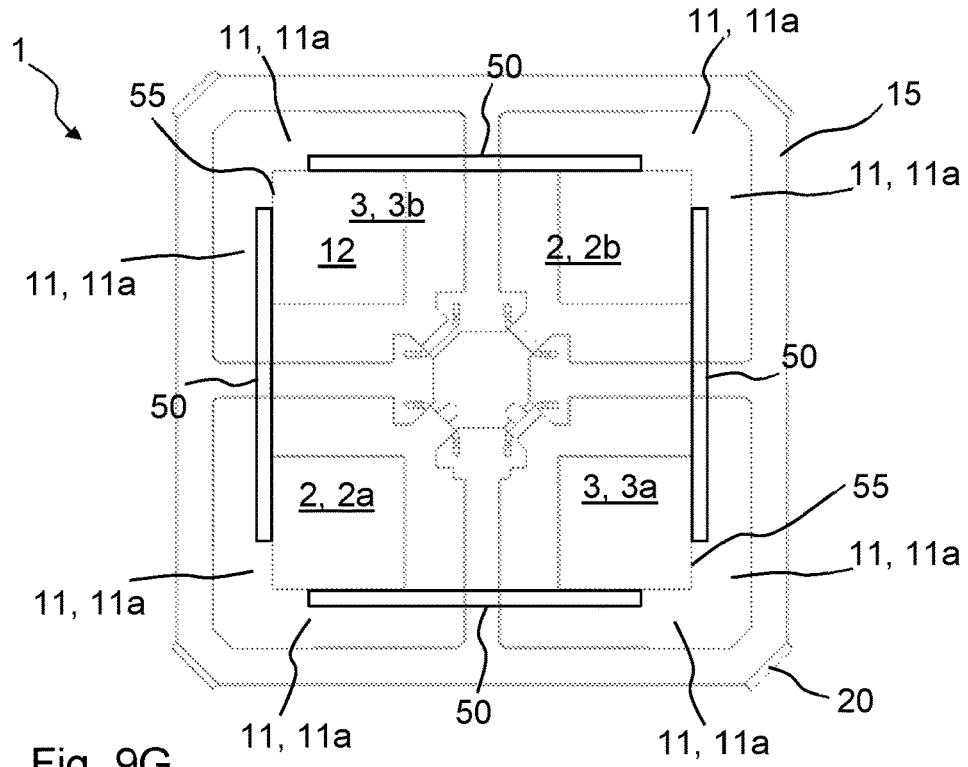

With regard to FIG. 9G, it is apparent that, in plan view, an inner edge of the metal strips 50 abuts the dipole-shaped antenna element arrangement 1 without overlap but flush with the recess 12 within the radiator halves 2*a*, 2*b*, 3*a*, 3*b*. In this case, the metal strips 50 overlap the radiator halves 2*a*, 2*b*, 3*a*, 3*b*, wherein each metal strip 50 preferably overlaps exactly two radiator halves (equally). This means that, in plan view, the inner edges of the metal strips 50 abut the dipole-shaped antenna element arrangement 1 flush with the respective inner edges 55 of the radiator halves 2*a*, 2*b*, 3*a*, 3*b* which define the recess 12.

Figure 9H:
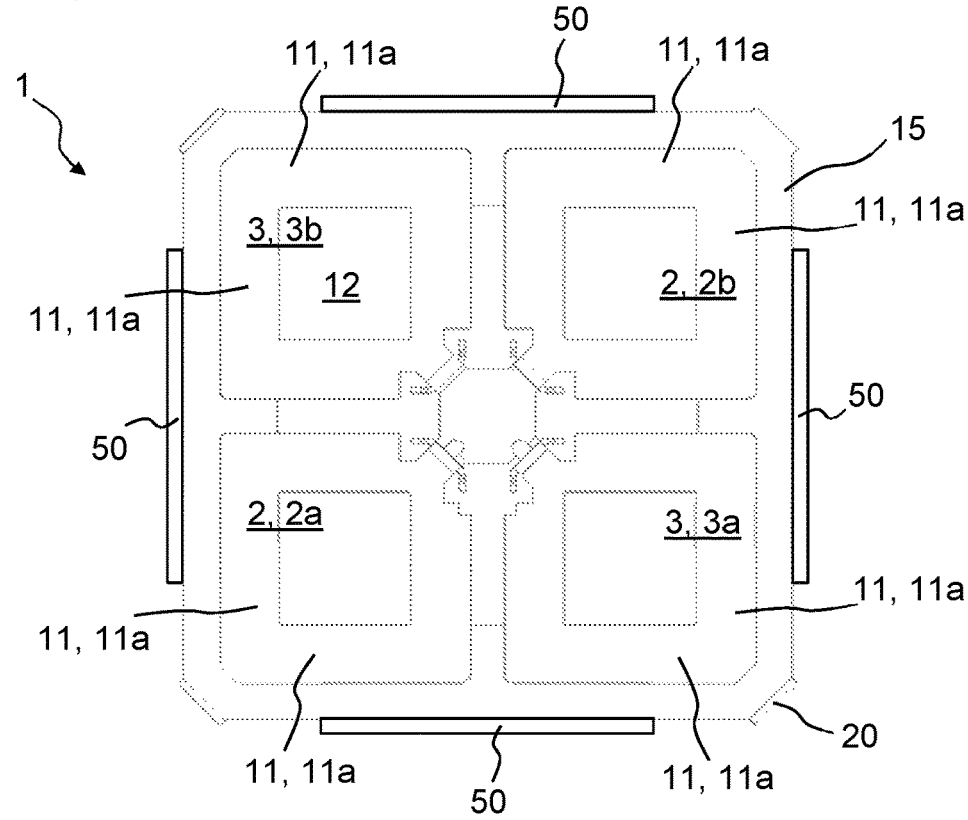

FIG. 9H shows a further embodiment of the dipole-shaped antenna element arrangement 1. In a plan view of the dipole-shaped antenna element arrangement 1, the metal strips 50 are arranged in such a way that they do not overlap the radiator halves 2*a*, 2*b*, 3*a*, 3*b* and the beam-shaping frame 15. An inner edge of the metal strips 50 extends in parallel with the outer peripheral wall 18*a* of the frame web 16 of the beam-shaping frame 15. The inner edges of the metal strips 50 lie, in plan view, on the dipole-shaped antenna element arrangement 1 flush with the outer peripheral wall 18*a* of the frame web 16 of the beam-shaping frame 15. This means that the inner edge of a metal strip 50 and the peripheral wall 18*a* lie in the same plane which extends perpendicularly to the radiator plane 5.

The metal strips 50 are preferably arranged symmetrically on the radiator halves 2*a*, 2*b*, 3*a*, 3*b* and the beam-shaping frame 15. This means that each of the two ends of each metal strip 50 is arranged equally far away from the respective corners of the radiator halves 2*a*, 2*b*, 3*a*, 3*b* and of the frame web 16 of the beam-shaping frame 15.

In principle, the width of the metal strips 50 could also change over the length of the metal strips.

FIG. 10 discloses a metal strip 50 of this type with reference to different views by way of example. The metal strip 50 is preferably constructed in one piece and consists of an electrically conductive element. In principle, it would be possible for the metal strip 50 also to be constructed from a dielectric covered with an electrically conductive layer. The metal strip 50 is preferably rectangular and has, for instance, a length that is approximately a quarter of the wavelength of the centre frequency. In principle, the length can be between 15% and 35%, preferably between 20% and 30% of the wavelength of the centre frequency. The width of the metal strip 50 is preferably less than 30%, more preferably less than 20%, more preferably less than 10% of the length of the metal strip 50. Preferably, the width of the metal strip 50 corresponds to from 0.5% to 2% of the wavelength of the centre frequency, more preferably 0.75% to 1.5%, and more preferably 1% of the wavelength of the centre frequency. The thickness of the metal strip 50 corresponds, for example, to less than 50% of the width of the metal strip 50.

The metal strip 50 can also have openings. Such openings would permit the combined holding of the passive beam-shaping frame 15 together with the metal strip 50 via at least one combined holding and spacing element, supported on one or all of the radiator halves 2*a*, 2*b*, 3*a*, 3*b*. A combined holding and spacing element of this type could engage by means of a clip-in or snap-in connection in the opening of the metal strip 50. Tool-free assembly of the metal strip 50 on the combined holding and spacing element would thus be possible. A combined holding and spacing element of this type is configured, for example, in such a way that it holds just one metal strip 50. In principle, the metal strip 50 could also have a multi-part configuration and comprise a plurality of metal strip elements.

The metal strip 50 has a width that is preferably smaller than the width of the peripheral frame web 16, that is to say, of the frame sides 15*a*, 15*b*, 15*c*, 15*d* of the beam-shaping frame 15. Furthermore, the width is preferably also smaller than the width of the outer sides 11*a* and/or the inner sides 11*b* of the radiator halves 2*a*, 2*b*, 3*a*, 3*b*. The length of the metal strip 50 is preferably smaller than the length of the frame sides 15*a*, 15*b*, 15*c*, 15*d* of the beam-shaping frame 15. The length of the metal strip 50 is, however, preferably greater or less than or equal to the length of the outer sides 11*a* and/or the inner sides 11*b* of the radiator halves 2*a*, 2*b*, 3*a*, 3*b*.

It should be noted that, in the dimensioning of the length for the individual elements, all intermediate ranges are to be regarded as disclosed.

The dipole-shaped antenna element arrangement 1 is configured, in particular, in the form of a vector dipole or a dipole square.

The longitudinal axis 8 is also a central axis 8 which penetrates the centre of the dipole-shaped antenna element arrangement 1 and more specifically perpendicularly to the reflector plane and the radiator plane 5.

The passive beam-shaping frame 15 is arranged together with the director 30 or the metal strips and the radiator halves 2*a*, 2*b*, 3*a*, 3*b* on the same side of the reflector 6, at a distance therefrom.

Some additional embodiments according to the dipole-shaped antenna element arrangement 1 are described in the following separately:

An additional advantage occurs when:

in a plan view of the dipole-shaped antenna element arrangement 1, at least part of the radiator halves 2*a*, 2*b*, 3*a*, 3*b* overlap, at least in part or in full with the broadenings 20 of the frame web 16 which are formed on the inner peripheral wall 18*b* thereof.

A further advantage appears when:

the broadenings 20 extend step by step; or the broadenings 20 occur continuously.

Another advantage comes along when:

the broadening 20 occurs perpendicularly to the radiator plane 5; and/or the corners of the outer peripheral wall 18*b* of the frame web 16 are bevelled over a length which corresponds to approximately the width of the frame web 16 at the non-broadened points thereof; and/or the broadenings 20 extend perpendicularly to the radiator plane 5, over a length which corresponds approximately to the width of the frame web 16 at the non-broadened points thereof.

Still another advantage occurs when:

in each case two frame sides 15*a*, 15*b*, 15*c*, 15*d* of the frame web 16 extend towards one another forming a corner, the broadenings 20, which extend in parallel with the radiator plane 5, each start at an equal distance from the corners on the individual frame sides 15*a*, 15*b*, 15*c*, 15*d* of the peripheral frame web 16 over a partial length of the respective frame sides.

A further advantage appears when:

the sides of the radiator frames 11 of the radiator halves 2*a*, 2*b* 3*a*, 3*b* are arranged in parallel with the frame sides 15*a*, 15*b*, 15*c*, 15*d* of the frame web 16; and/or corners of the radiator frames 11 of the radiator halves 2*a*, 2*b*, 3*a*, 3*b*, which face towards the corners of the passive beam-shaping frame 15, are bevelled.

Still another advantage comes along when:

each frame side 15*a*, 15*b*, 15*c*, 15*d* is formed from one combined part in one piece together with the respective vane 40; and/or on each frame side 15*a*, 15*b*, 15*c*, 15*d*, at least one vane 40 is provided; and/or in plan view, at least one vane 40 is rectangular or square or trapezoid or semi-circular or half-oval, or the edge contour of the at least one vane 40 is n-polygonal in plan view.

An additional advantage occurs when:

at least one vane 40 extends away from an inner peripheral wall 18*b* of the frame web 16 of the respective frame side 15*a*, 15*b*, 15*c*, 15*d* towards the opening 17 which the frame web 16 surrounds; and/or at least one vane 40 extends outwardly away from an outer peripheral wall 18*a* of the frame web 16 of the respective frame side 15*a*, 15*b*, 15*c*, 15*d*.

Another advantage happens when:

at least four metal strips 50 exist, one of the metal strips 50 being arranged in each case in the region of the outer sides 11*a* of in each case two adjacent radiator halves 2*a*, 3*a*; and 3*a*, 2*b*; and 2*b*, 3*b*; and 3*b*, 2*a* respectively.

The invention is not restricted to the described embodiments. In the context of the invention, all the features described and/or illustrated can be freely combined with one another.

The invention claimed is:

1. Dipole-shaped antenna element arrangement comprising:

two pairs of radiator halves which are arranged so as to be rotated by 90° to one another, in such a way that the dipole-shaped antenna element arrangement transmits and/or receives in two polarisation planes which are arranged perpendicularly to one another;

the radiator halves configured to be arranged in a radiator plane at a distance in front of a reflector and in parallel therewith;

a balancing and/or support arrangement comprising a first end and a base which is arranged at a second end which is opposite the first end, the radiator halves being arranged at the first end of the balancing and/or support arrangement and thereon, and the base being able to be arranged on a base body; and a passive beam-shaping frame which is arranged at a distance from the radiator halves towards the base;

the passive beam-shaping frame comprising a plurality of frame sides which form a peripheral frame web which defines an opening;

the passive beam-shaping frame being oriented in parallel with the radiator plane;

wherein the passive beam-shaping frame has, in the region of the corners thereof, a broadening of the peripheral frame web thereof, said broadening of the frame web extending in parallel with the radiator plane and/or transversely to the radiator plane.

2. Dipole-shaped antenna element arrangement according to claim 1, wherein:

the broadenings of the frame web occur on the inner peripheral wall thereof so that, in the region of the corners thereof, the frame web extends closer to a longitudinal axis through the dipole-shaped antenna element arrangement; and/or the broadenings of the frame web occur on the outer peripheral wall thereof.

3. Dipole-shaped antenna element arrangement according to claim 2, wherein:

the outer peripheral wall of the frame web is bevelled in the region of the corners thereof, the broadening being configured transversely to the radiator plane on said bevel;

the broadening extends transversely to the radiator plane towards the base of the balancing and/or support arrangement or extends in the direction of the radiator plane.

4. Dipole-shaped antenna element arrangement according to claim 1, wherein:

the broadenings of the frame web in parallel with the radiator plane a) extend over a partial length of the individual frame sides of the peripheral frame web, the partial length corresponding to less than 30%, preferably less than 20% of the length of the individual frame sides; and/or b) are greater than 10%, preferably greater than 20%, more preferably greater than 25% but less than 40%, more preferably less than 35% of the width of the peripheral frame web at the non-broadened points thereof and correspond more preferably to 35% of the width of the peripheral frame web at the non-broadened points thereof.

5. Dipole-shaped antenna element arrangement according to claim 1, wherein:

the peripheral frame web of the passive beam-shaping frame has interruptions or is configured without interruptions; and/or the passive beam-shaping frame is configured in one piece.

6. Dipole-shaped antenna element arrangement according to claim 1, wherein:

the passive beam-shaping frame is rectangular, in particular square; and/or the radiator halves comprise a rectangular, in particular square, radiator frame.

7. Dipole-shaped antenna element arrangement according to claim 1, wherein:

a plurality of frame sides of the passive beam-shaping frame each comprise at least one vane in the middle thereof;

the vanes extend approximately in parallel with the radiator plane or transversely to the radiator plane.

8. Dipole-shaped antenna element arrangement according to claim 1, wherein:

a director, the director being oriented in parallel with the radiator plane;

the radiator halves are arranged closer to the base than the director;

the outer sides of the director are arranged so as to be rotated by an angle of between 30° and 60°, preferably by 45° to the outer sides and/or inner sides of the radiator halves.

9. Dipole-shaped antenna element arrangement according to claim 8, wherein:

the radiator halves are arranged between the passive beam-shaping frame and the director;

the director is rectangular, in particular square;

the outer sides of the director are arranged so as to be rotated by 45° to the frame sides of the frame web and/or rotated by 45° to the outer sides and/or inner sides of the radiator halves.

10. Dipole-shaped antenna element arrangement according to claim 9, wherein:

the director comprises a recess in the centre thereof.

11. Dipole-shaped antenna element arrangement according to claim 10, wherein:

the recess of the director is square, the inner sides of the recess of the director being in parallel with the outer sides of the director.

12. Dipole-shaped antenna element arrangement according to claim 9, wherein:

the director comprises, on each outer side, a tongue protruding outwardly in parallel with the radiator plane;

the protruding tongue is preferably provided in the middle of each outer side of the director.

13. Dipole-shaped antenna element arrangement according to claim 11, wherein:

the inner sides of the recess of the director have a length that is 10% to 25% of the length of the outer sides of the director; and/or the tongues are formed over a length on the outer sides of the director and thereon, which is more than 10%, preferably more than 20%, preferably more than 30%, preferably more than 40%, but less than 55%, preferably less than 45%, more preferably less than 35%, more preferably less than 25% and more preferably less than 15% of the length of an outer side of the director; and/or the tongues are formed over a width on the outer sides of the director, which is more than 1%, preferably more than 4%, preferably more than 6%, preferably more than 8%, but less than 12%, preferably less than 9%, more preferably less than 7%, more preferably less than 5% and more preferably less than 3% of the length of an outer side of the director.

14. Dipole-shaped antenna element arrangement according to claim 12, wherein:

in a plan view of the director, the outer side of each tongue extends in parallel with a diagonal through each radiator half.

15. Dipole-shaped antenna element arrangement according to claim 1, wherein:

a plurality of metal strips, the metal strips being oriented in parallel with the radiator plane;

the radiator halves are arranged lying closer to the base than the metal strips;

in a plan view, the metal strips are arranged on the dipole-shaped antenna element arrangement preferably in the region of the outer sides of the radiator halves.

16. Dipole-shaped antenna element arrangement according to claim 15, wherein:

each metal strip extends approximately in parallel with in each case two outer sides of two adjacent radiator halves; and/or each metal strip extends in parallel with in each case one frame side of the frame web; and/or each metal strip is arranged in such a way that it does not overlap with a recess situated within the radiator halves.

17. Dipole-shaped antenna element arrangement according to claim 15, wherein:

in a plan view of the dipole-shaped antenna element arrangement, at least a partial width of at least one metal strip overlaps two outer sides of two adjacent radiator halves; or in a plan view of the dipole-shaped antenna element arrangement, at least one metal strip directly abuts two outer sides of two adjacent radiator halves without overlap, the at least one metal strip being arranged at a distance from the radiator halves towards the longitudinal axis; or in a plan view of the dipole-shaped antenna element arrangement, at least one metal strip is arranged at a distance relative to the two outer sides of two adjacent radiator halves without overlap towards the longitudinal axis, in a plan view, a gap still being formed between the metal strip and the two adjacent radiator halves, and the at least one metal strip being further away from the longitudinal axis than the radiator halves; or the at least one metal strip is arranged in such a way that it does not overlap the radiator halves and the beam-shaping frame and in such a way that, in a plan view of the dipole-shaped antenna element arrangement, the at least one metal strip directly abuts the respective outer peripheral wall of the frame web of the beam-shaping frame.

18. Dipole-shaped antenna element arrangement according to claim 15, wherein:

a distance between the metal strips and the radiator halves is smaller than a distance between the radiator halves and the passive beam-shaping frame; and/or each metal strip comprises one or more metal strip elements or consists of one or more of said metal strip elements; and/or each metal strip is rectangular and has a length that is approximately a quarter of the wavelength of the centre frequency.

19. Dipole-shaped antenna element arrangement according to claim 15, wherein:

the metal strips are all arranged in the same plane; or the metal strips are arranged in at least two different planes which extend in parallel with the radiator plane but are at different distances therefrom, at least two or exactly two metal strips being arranged in each of said planes.

20. Dipole-shaped antenna element arrangement according to claim 9, wherein:

the passive beam-shaping frame is held, together with the director or the metal strips, galvanically separated via at least one combined holding and spacing element, supported on one or all of the radiator halves and at a distance therefrom.

* * * * *